US011215157B2

(12) United States Patent
Terada

(10) Patent No.: US 11,215,157 B2
(45) Date of Patent: Jan. 4, 2022

(54) IGNITION CONTROL DEVICE FOR INTERNAL COMBUSTION ENGINE

(71) Applicant: DENSO CORPORATION, Kariya (JP)

(72) Inventor: Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/103,088

(22) Filed: Nov. 24, 2020

(65) Prior Publication Data

US 2021/0079881 A1 Mar. 18, 2021

Related U.S. Application Data

(63) Continuation of application No. PCT/JP2019/020567, filed on May 24, 2019.

(30) Foreign Application Priority Data

May 25, 2018 (JP) ..... JP2018-100973

(51) Int. Cl.
*F02P 3/05* (2006.01)
*H01F 38/12* (2006.01)
*H01T 13/04* (2006.01)

(52) U.S. Cl.
CPC ..... *F02P 3/05* (2013.01); *H01F 38/12* (2013.01); *H01T 13/04* (2013.01)

(58) Field of Classification Search
CPC .... F02P 3/05; F02P 9/002; F02P 17/12; F02P 3/053; F02P 3/0456; F02P 15/10; H01F 38/12; H01T 13/04
See application file for complete search history.

(56) References Cited

U.S. PATENT DOCUMENTS 4,361,129 A * 11/1982 Sugie ..... F02P 7/035 123/622
6,275,041 B1 * 8/2001 Okamura ..... F02P 17/12 324/380
6,766,243 B1 * 7/2004 Haussmann ..... F02D 41/266 123/339.11
8,893,692 B2 * 11/2014 Brandes ..... F02P 3/053 123/644

(Continued)

FOREIGN PATENT DOCUMENTS

WO 2016/157541 10/2016

*Primary Examiner* — Joseph J Dallo
(74) *Attorney, Agent, or Firm* — Nixon & Vanderhye P.C.

(57) ABSTRACT

In an ignition control device for an internal-combustion engine, signal separation circuitry receives and separates an ignition control signal that is an integrated signal of a main ignition signal for controlling the main ignition operation, an energy input signal for controlling the energy input operation, and a target secondary current command signal. The ignition control signal is formed of a first signal and a second signal that are pulsed signals. The signal separation circuitry is configured to generate, from the ignition control signal, the main ignition signal based on rising edges of the first signal and the second signal as pulse-waveform information of the first signal and the second signal, generate the energy input signal based on a pulse width of the second signal as pulse-waveform information of the second signal, and generate the target secondary current command signal based on pulse-waveform information of the first signal.

15 Claims, 13 Drawing Sheets

(56) References Cited

U.S. PATENT DOCUMENTS

| | | | | |
|---|---|---|---|---|
| 2007/0267004 | A1* | 11/2007 | Yamauchi | F02P 3/0892 123/604 |
| 2010/0307468 | A1* | 12/2010 | Puettmann | F02P 3/0414 123/636 |
| 2016/0084215 | A1* | 3/2016 | Kondou | F02P 3/0435 123/620 |
| 2017/0022957 | A1* | 1/2017 | Hayashi | F02P 9/007 |
| 2017/0022960 | A1* | 1/2017 | Takeda | F02P 5/15 |
| 2017/0030318 | A1* | 2/2017 | Nakamura | F02P 9/007 |
| 2017/0045025 | A1* | 2/2017 | Nakayama | F02P 17/12 |
| 2018/0195485 | A1* | 7/2018 | Seimiya | F02P 15/02 |

* cited by examiner

IGNITION CONTROL DEVICE FOR INTERNAL COMBUSTION ENGINE

CROSS-REFERENCE TO RELATED APPLICATION

The present application is a continuation application of International Application No. PCT/JP2019/020567, filed May 24, 2019, which claims priority to Japanese Patent Application No. 2018-100973 filed May 25, 2018. The contents of these applications are incorporated herein by reference in their entirety.

BACKGROUND

Technical Field

This disclosure relates to an ignition control device for controlling ignition of an internal-combustion engine.

An ignition control device for a spark ignition type engine of a vehicle includes an ignition coil formed of a primary and a secondary coil and connected to a spark plug for each cylinder of the engine, and applies, to the spark plug, a high voltage induced in the secondary coil upon de-energization of the primary coil to produce a spark discharge. In order to increase the ignitability of an air-fuel mixture by the spark discharge, the ignition control device is provided with means for inputting discharge energy after the spark discharge is started, enabling the spark discharge to be continued.

During the spark discharge, the operation of ignition by a single ignition coil may be repeatedly performed a plurality of times. To perform stable ignition control in such multiple ignitions, discharge energy may be added during a spark discharge caused by the main ignition operation so as to increase the secondary current in a superimposed manner. For example, an ignition device is known that includes an energy input circuit configured to sequentially conduct the secondary current in the same direction after the main ignition to thereby cause the spark discharge to be continued in the same direction, and controls a secondary current value during continued discharge and thereby achieves increased energy efficiency.

DESCRIPTION OF SPECIFIC EMBODIMENTS

Figure 1:
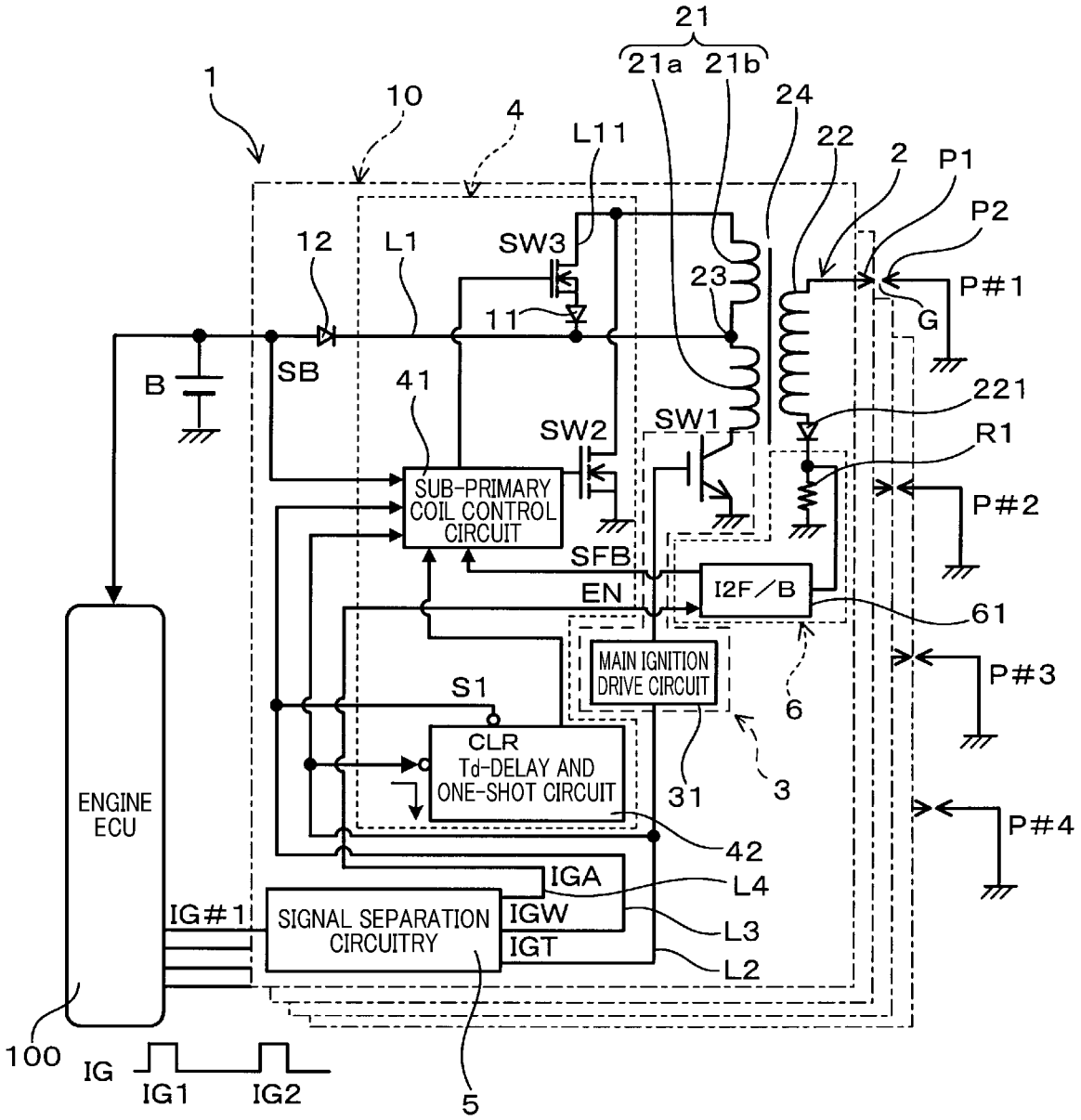
FIG. 1 is a schematic circuit diagram of an ignition control device for an internal-combustion engine according to a first embodiment.

The above known ignition device, as disclosed in, for example, JP-A-2015-206355, outputs, using signal lines, a main ignition signal IGT and a discharge continuation signal IGW for energy input from an engine control unit that controls an amount of input energy. The above known ignition device outputs, using another signal line, a secondary current command signal IGA. In an alternative embodiment, the above known ignition device may output a composite signal IGWA of the discharge continuation signal IGW and the secondary current command signal IGA from the engine control unit to the ignition device. The ignition device extracts the discharge continuation signal IGW from the composite signal IGWA, and outputs a secondary current command value based on a phase difference between the main ignition signal IGT and the composite signal IGWA.

The above known ignition device needs at least two signals (e.g., the main ignition signal IGT and the composite signal IGWA) to be transmitted from the engine control unit for performing main ignition and energy input. In such a configuration, as the number of signals increases, the number of signal terminals provided in each of the engine control unit and the ignition device and the number of signal lines connected between the engine control unit and the ignition device both increase. Accordingly, as the number of cylinders of the engine increases, the system configuration becomes more complicated, leading to an increased space to install the system in the vehicle and thus to a more expensive system.

In view of the above, it is desired to have a small-sized and high-performance ignition control device for an internal-combustion engine, which allows the main ignition operation and the energy input operation to be performed by transmission of a minimum number of signals and enables reduction in the number of signal terminals and in the number of signal lines.

One aspect of this disclosure provides an ignition control device for an internal-combustion engine, including: an ignition coil (2) formed of a primary coil (21) and a secondary coil (22), for generating discharge energy in the secondary coil (22) connected to a spark plug (P) by increasing or decreasing a primary current (I1) flowing through the primary coil (21); main ignition circuitry (3) configured to control energization of the primary coil to perform a main ignition operation for generating a spark discharge in the spark plug; energy input circuitry (4) configured to perform an energy input operation for superposing, on a secondary current (I2) flowing through the secondary coil generated by the main ignition operation, a current of same polarity; signal separation circuitry (5) configured to receive an ignition control signal (IG) that is an integrated signal of a main ignition signal (IGT) for controlling the main ignition operation, an energy input signal (IGW) for controlling the energy input operation, and a target secondary current command signal (IGA), and separate the received ignition control signal (IG) into the main ignition signal (IGT), the energy input signal (IGW), and the target secondary current command signal (IGA) that are included in the received ignition control signal (IG), wherein the ignition control signal is formed of a first signal (IG1) and a second signal (IG2) that are pulsed signals, and the signal separation circuitry is configured to generate, from the ignition control signal (IG), the main ignition signal (IGT) based on rising edges of the first signal and the second signal as pulse-waveform information of the first signal and the second signal, generate the energy input signal (IGW) based on a pulse width of the second signal as pulse-waveform information of the second signal, and generate the target secondary current command signal based on pulse-waveform information of the first signal.

In the above ignition control device, the ignition control signal received at the signal separation circuitry is separated into three signals, that is, the main ignition signal, the energy input signal, and the target secondary current command signal, using pulse-waveform information of the first signal and the second signal. The pulse-waveform information of the first signal and the second signal includes some pieces of information, such as timings of rising and falling edges of each of the first signal and the second signal, spacings between these edges, a pulse width of each of the first signal and the second signal. The signal separation circuitry generates the three signals based on each single piece of information and/or combinations of these pieces of information and transmits to corresponding parts. With this configuration, the main ignition operation and the energy input operation are sequentially performed in the main ignition circuitry and the energy input circuitry, respectively. Control of the secondary current can appropriately be performed based on the target secondary current command signal.

In the above ignition control device, the ignition control signal that is an integrated signal of the three signals is received at the signal separation circuitry, which can minimize an increase in the number of signal terminals and an increase in the number of signal lines due to an increase in the number of cylinders of the engine. This enables efficient ignition control while preventing complication of system configuration and an increase in space to install the system in the vehicle.

This can provide a small-sized and high-performance ignition control device for an internal-combustion engine, which allows the main ignition operation and the energy input operation to be performed by transmission of a minimum number of signals and enables reduction in the number of signal terminals and in the number of signal lines.

Hereinafter, exemplary embodiments of the present disclosure will be described in detail with reference to the accompanying drawings, in which like reference numerals refer to like or similar elements regardless of reference numerals and duplicated description thereof will be omitted.

First Embodiment

An ignition control device for an internal-combustion engine according to a first embodiment will now be described with reference to FIGS. 1-4.

In FIG. 1, the ignition control device 1 is applicable to, for example, a spark ignition type engine for a vehicle and controls ignition of a spark plug P for each cylinder. The ignition control device 1 includes an ignition device 10 for each cylinder, and an engine electronic control unit (engine ECU) 100 as an ignition control signal transmitter that provides an ignition command to each ignition device 10. The ignition device 10 includes an ignition coil 2, main ignition circuitry 3, energy input circuitry 4, and signal separation circuitry 5, The ignition coil 2 generates discharge energy in a secondary coil 22 connected to the spark plug P by increasing or decreasing the primary current I1 flowing through a primary coil 21. The main ignition circuitry 3 controls energization of the primary coil 21 of the ignition coil 2 to perform the main ignition operation to create a spark discharge in the spark plug P. The energy input circuitry 4 performs the energy input operation to superpose, on a secondary current I2 flowing through the secondary coil 22 caused by the main ignition operation, a current of the same polarity. The primary coil 21 includes, for example, a main primary coil 21*a* and a sub-primary coil 21*b*. The energy input circuitry 4 controls the energy input operation by controlling energization of the sub-primary coil 21*b*.

The engine ECU 100 generates and transmits, every combustion cycle (e.g., every 720° crankshaft angle (CA)), an ignition control signal IG including a first pulsed signal IG1 and a second pulsed signal IG2. The ignition control signal IG is transmitted as an integrated signal of a main ignition signal IGT for controlling the main ignition operation, an energy input signal IGW for controlling the energy input operation, and a target secondary current command signal IGA. After initiation of operation of the ignition control device 1, the first signal IG1 and the second signal IG2 of the ignition control signal IG are transmitted repeatedly in this order from the engine ECU 100 to the ignition device 10. This enables identification of the first signal IG1 and the second signal IG2 of the ignition control signal IG.

The signal separation circuitry 5 receives the ignition control signal IG and separates the ignition control signal IG into two or more signals. That is, the signal separation circuitry 5 generates a main ignition signal IGT based on pulse-waveform information of the first signal IG1 and the second signal IG2, an energy input signal IGW based on pulse-waveform information of the second signal IG2, and a target secondary current command signal IGA based on pulse-waveform information of the of the first signal IG1.

Figure 2:
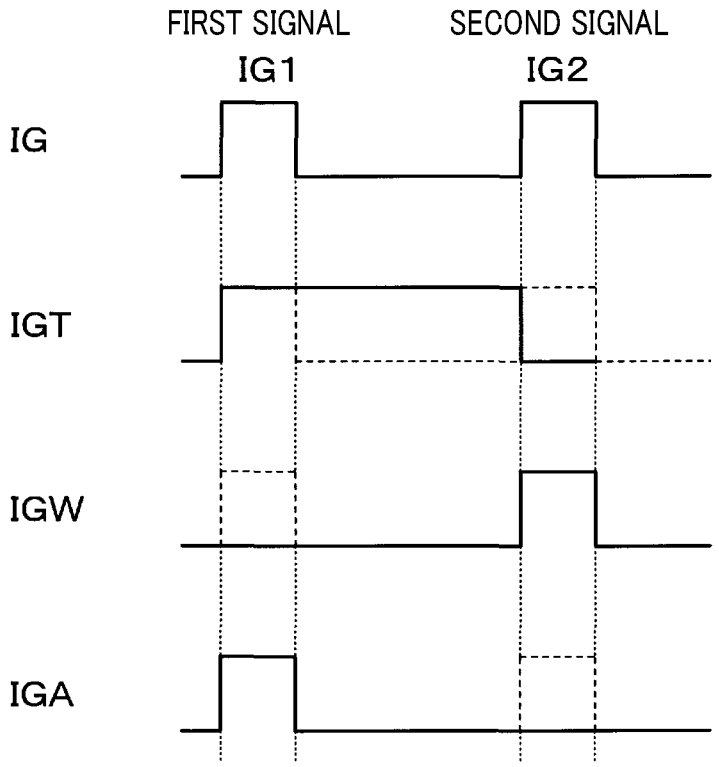
FIG. 2 is a waveform chart of an ignition control signal, a main ignition signal generated from the ignition control signal, an energy input signal, and a target secondary current command signal according to the first embodiment.

More specifically, as illustrated in FIG. 2, using information included in the received ignition control signal IG, the signal separation circuitry 5 generates the main ignition signal IGT based on information about rising edges of the first signal IG1 and the second signal IG2, and the energy input signal IGW based on a pulse width of the second signal IG2.

The signal separation circuitry 5 generates the target secondary current command signal IGA based on pulse-waveform information of the first signal IG1. In the present embodiment, for example, the signal separation circuitry 5 generates the target secondary current command signal IGA based on a pulse width of the first signal IG1 and indicates a target secondary current value I2*tgt*.

The ignition control device 1 activates the main ignition circuitry 3 based on the main ignition signal IGT to perform the main ignition operation. After the main ignition, the ignition control device 1 activates the energy input circuitry 4 based on the energy input signal IGW to perform the energy input operation, thereby continuing the spark discharge. Energy to be input during this continued discharge is indicated by the target secondary current command signal IGA. The ignition control device 1 further includes a feedback controller 6 that feedback controls the secondary current I2. Based on the target secondary current command signal IGA, the feedback controller 6 feedback controls the secondary current I2 flowing through the secondary coil 22 of the ignition coil 2 to the target secondary current value I2*tgt*.

Various components of the ignition control device 1 will now be described.

The engine that the ignition control device 1 is applicable to may be a four-cylinder engine or the like. Each cylinder of the engine is equipped with the spark plug P (denoted by, e.g., P #1, . . . , P #4 in FIG. 1) and the ignition device 10 associated therewith. The ignition control signal IG is to be transmitted from the engine ECU 100 to each ignition device 10.

The spark plug P includes a central electrode P1 and a ground electrode P2 opposing each other with a spark gap G between tips of these electrodes. The spark plug P is supplied with discharge energy to generate a spark discharge in the ignition coil 2 based on the ignition control signal IG, enabling ignition of an air-fuel mixture within the engine combustion chamber. Energization of the ignition coil 2 is controlled based on the main ignition signal IGT, the energy input signal IGW, and the target secondary current command signal IGA included in the ignition control signal IG.

The ignition coil 2 forms a boost transformer in which the main primary coil 21*a* and the sub-primary coil 21*b* of the primary coil 21 and the secondary coil 22 are magnetically coupled to each other. A first end of the secondary coil 22 is connected to a central electrode P1 of the spark plug P and a second end of the secondary coil 22 is grounded via a first diode 221 and a secondary current sense resistor R1. An anode terminal of the first diode 221 is connected to the secondary coil 22 and a cathode terminal of the first diode 221 is connected to the secondary current sense resistor R1, thereby restricting a direction of the secondary current I2 flowing through the secondary coil 22. The secondary current sense resistor R1 and a secondary current feedback circuit (for example, denoted by I2F/B in FIG. 1) 61 described later in detail form the feedback controller 6.

The main primary coil 21*a* and the sub-primary coil 21*b* are connected in series and in parallel with a DC power source B, such as a vehicle battery or the like. More specifically, a center tap 23 is provided between a first end of the main primary coil 21*a* and a first end of the sub-primary coil 21*b*. The center tap 23 is connected to a power line L1 extending to the DC power source B. A second end of the main primary coil 21*a* is grounded via a switching element for main ignition (referred to as a main ignition switch) SW1. A second end of the sub-primary coil 21*b* is grounded via a switching element for continuation of discharge (referred to as a discharge continuation switch) SW2.

With this configuration, driving on the main ignition switch SW1 or the discharge continuation switch SW2 enables application of a battery voltage to the primary coil 21*a* or the sub-primary coil 21*b*. The main ignition switch SW1 forms part of the main ignition circuitry 3. The discharge continuation switch SW2 forms part of the energy input circuitry 4.

In the ignition coil 2, the primary coil 21 wound around a primary coil bobbin and the secondary coil 22 wound around a secondary coil bobbin are integrated with each other with the primary coil bobbin and the secondary coil bobbin placed around a core 24. A sufficiently large ratio of the number of turns of the secondary coil 22 to the number of turns of the main primary coil 21*a* or the sub-primary coil 21*b* of the primary coil 21 can cause a high voltage in the secondary coil 22 depending on the turns ratio. The main primary coil 21*a* and the sub-primary coil 21*b* are wound such that directions of magnetic fluxes induced in the main primary coil 21*a* and the sub-primary coil 21*b* during energization by DC power source B are opposite from each other. The number of turns of the sub-primary coil 21*b* is set smaller than the number of turns of the main primary coil 21*a*. After generation of a spark discharge in the spark gap G of the spark plug P by a voltage generated by de-energization of the main primary coil 21*a*, this allows a superposition magnetic flux in the same direction to be induced by energization of the sub-primary coil 21*b*, which can thereby increase discharge energy in a superposed manner.

The main ignition circuitry 3 includes a main ignition operation switch drive circuit (referred to as a main ignition drive circuit) 31 that drives on or off the main ignition switch SW1 and the main ignition switch SW1. The main ignition switch SW1 is a voltage-driven switching element, such as an insulated gate bipolar transistor (IGBT). A collector terminal and an emitter terminal of the main ignition switch SW1 are connected or disconnected by controlling a gate potential of the main ignition switch SW1 in response to a drive signal input to the gate terminal of the main ignition switch SW1. The collector terminal of the main ignition switch SW1 connected to the second end of the main primary coil 21*a*. The emitter terminal of the main ignition switch SW1 is grounded.

The main ignition drive circuit 31 generates a drive signal in response to the main ignition signal IGT and drives on or off the main ignition switch SW1. More specifically (and referring to FIG. 4), upon turning on the main ignition switch SW1 at the rising edge of the main ignition signal IGT, the main primary coil 21*a* is energized and the primary current I1 flows. Subsequently, upon turning off the main ignition switch SW1 at the falling edge of the main ignition signal IGT, the main primary coil 21*a* is de-energized, and a high voltage is induced in the secondary coil 22 by mutual induction. This high voltage is applied across the park gap G of the spark plug P, which generates a spark discharge and a flow of secondary current I2.

The energy input circuitry 4 includes the discharge continuation switch SW2 and a sub-primary coil control circuit 41 configured to output a drive signal for driving on or off the discharge continuation switch SW2 to control energization of the sub-primary coil 21*b*, and a one-shot pulse generation circuit (referred to as a Td-delay and one-shot circuit) 42 configured to set a predefined delay time Td of the energy input operation. The energy input circuitry 4 further includes a switching element (referred to as a freewheeling current switch) SW3 for opening or closing the freewheeling current path L11 connected to the sub-primary coil 21*b*. The freewheeling current switch SW3 is turned on or off by a drive signal from the sub-primary coil control circuit 41.

Each of the discharge continuation switch SW2 and the freewheeling current switch SW3 is a voltage-driven switching element, such as a metal-oxide semiconductor field-effect transistor (MOSFET). For each of the discharge continuation switch SW2 and the freewheeling current switch SW3, a drain terminal and a source terminal are connected or disconnected by controlling a gate potential in response to a drive signal input to the gate terminal. The drain terminal of the discharge continuation switch SW2 is connected to the second end of the sub-primary coil 21*b*. The source terminal of the discharge continuation switch SW2 is grounded.

The freewheeling current path L11 is provided between the second end of the sub-primary coil 21*b* (on the opposite side from the main primary coil 21*a*) and the power line L1. A drain terminal of the freewheeling current switch SW3 is connected to a connection point between the second end of the sub-primary coil 21*b* and the discharge continuation switch SW2. A source terminal of the freewheeling current switch SW3 is connected to the power line L1 via a second diode 11. A third diode 12 is provided along the power line L1 and between the DC power source B and the connection point between the power line L1 and the freewheeling current path L11. The forward direction of the second diode 11 is a direction toward the power line L1. The forward direction of the third diode 12 is a direction toward the primary coil 21. Driving on the freewheeling current switch SW3 while the discharge continuation switch SW2 is off allows the second end of the sub-primary coil 21*b* and the power line L1 to be connected via the freewheeling current path L11. Hence, upon de-energization of the sub-primary coil 21*b*, the freewheeling current flows and the current flowing through the sub-primary coil 21*b* changes slowly, which can prevent a sharp drop in the secondary current I2.

The main ignition signal IGT, the energy input signal IGW, and the target secondary current command signal IGA input from the signal separation circuitry 5 to the sub-primary coil control circuit 41 via the output signal lines L2 through L4. The output signal line L2 for the main ignition signal IGT is connected to an input terminal of the Td-delay and one-shot circuit 42. A delayed one-shot pulse signal S1 is output from the Td-delay and one-shot circuit 42 to the sub-primary coil control circuit 41. A feedback signal SFB is input from a secondary current feedback circuit 61 of the feedback controller 6 to the sub-primary coil control circuit 41. A battery voltage signal SB is input from the power line L1 to the sub-primary coil control circuit 41, where these signals are used to determine whether the energy input operation is to be enabled.

The Td-delay and one-shot circuit 42 has a function of setting an energy input start time after the main ignition operation, also serves as an energy input enabling period setter to set an enabling period for enabling the energy input operation in the ignition device 10, and outputs a pulse signal that is an enabling signal for enabling the energy input operation. The energy input operation enabling signal is, for example, a pulse signal that is generated by using the main ignition signal IGT as a trigger, based on the output signal from the signal separation circuitry 5. A maximum length of the energy input operation enabling period is set to a pulse width of the pulse signal. The Td-delay and one-shot circuit 42 outputs the pulse signal based on the main ignition signal IGT. After indicating the start of the energy input period, the Td-delay and one-shot circuit 42 can indicate the end of the energy input period based on the energy input signal IGW.

More specifically, upon detecting a falling edge of the main ignition signal IGT, the Td-delay and one-shot circuit 42 generates a one-shot pulse signal S1 of a pulse width greater than that of the energy input signal IGW, with a predefined delay time Td, and outputs the one-shot pulse signal S1 to the sub-primary coil control circuit 41. The output signal line L3 for the energy input signal IGW is connected to a clear terminal CLR of the Td-delay and one-shot circuit 42. The Td-delay and one-shot circuit 42 is reset by a LOW level signal of the energy input signal IGW.

When the energy input signal IGW that indicates a duration of the energy input operation is output, the delay time Td is provided to perform the energy input operation at the timing when the discharge would have been initiated after the main ignition operation. For example, the delay time Td may be appropriately set such that the energy input operation is performed after the secondary current I2 generated by the main ignition operation has decreased to some certain degree.

This can prevent wasteful energization of the sub-primary coil 21*b* that may be caused by energy input indication before a discharge occurs or before the secondary current I2 deceases to a target value. Since the pulse width of the one-shot pulse signal S1 from the Td-delay and one-shot circuit 42 is set to a maximum period acceptable to the ignition device 10, the energy input operation can be terminated in the ignition device 10 even if the energy input signal IGW is fixed at HIGH or the duration of energy input becomes an excessive period than expected, enabling protection of the device. If the duration of energy input signal IGW is within expected, the Td-delay and one-shot circuit 42 is cleared by a LOW level output of the energy input signal IGW to initialize the output pulse to a LOW level, and thereby ready for subsequent operation.

The output signal line L4 for the target secondary current command signal IGA is connected to an input terminal of the secondary current feedback circuit 61. The secondary current feedback circuit 61 compares the target secondary current command signal IGA as input with a measurement of secondary current I2 based on the secondary current sense resistor R1 and outputs a comparison result to the sub-primary coil control circuit 41. The secondary current feedback circuit 61 thresholds the detected secondary current I2 based on a target secondary current value I2*tgt* indicated by the target secondary current command signal IGA and outputs a feedback signal SFB to drive the discharge continuation switch SW2 on and off.

Based on a combination of signals from these components, for example, execution of feedback control based on the feedback signal, a battery voltage signal SFB, and the like, the sub-primary coil control circuit 41 determines whether it is necessary to perform the energy input operation and generate a drive signal at a predefined timing, thereby driving on or off the discharge continuation switch SW2 and the freewheeling current switch SW3. More specifically (for example, referring to FIG. 4), a target secondary current value I2*tgt* is indicated using the target secondary current command signal IGA as a reference voltage of a comparator, and an energy input period is indicated based on the energy input signal IGW. Based on a result of ANDing the energy input signal IGW and the pulse signal that is output the predefined delay time Td after a falling edge of the main ignition signal IGT where a discharge would have been initiated in the spark gap G of the spark plug 2, a drive signal of the discharge continuation switch SW2 is output, and the energy input operation will be performed. During execution of the energy input operation, based on a result of comparison of the measurement of the secondary current I2 and the target secondary current command signal IGA, feedback control is performed such that the secondary current value is kept at the target secondary current value I2*tgt*.

To perform feedback control of the secondary current I2 based on the target secondary current command signal IGA, current feedback control circuitry, as disclosed in, for example, JP-A-2015-200300 may be employed as the secondary current feedback circuit 61.

More specifically, the secondary current feedback circuit 61 includes a comparison circuit adapted to compare the detected secondary current I2 with a threshold, and switching means for switching thresholds provided by supplying the target secondary current command signal IGA. A detection signal as a result of voltage conversion by the secondary current sense resistor R1 and whichever of an upper-limit threshold and a lower limit threshold has been appropriately selected are input to the comparison circuit. In response to a result of comparison, the discharge continuation switch SW2 is driven on or off. Among the upper-limit threshold and the lower limit threshold, the upper-limit threshold is selected when the secondary current I2 is increasing while the discharge continuation switch SW2 is closed, and the lower-limit threshold is selected when the secondary current I2 is decreasing while the discharge continuation switch SW2 is open.

As described later, in cases where the target secondary current value I2*tgt* indicated by the target secondary current command signal IGA is selected from a plurality of target secondary current values, the upper-limit threshold and the lower limit threshold are switched in response to which of target secondary current values is selected.

For example, to drive the discharge continuation switch SW2, the sub-primary coil control circuit 41 includes an AND circuit for ANDing the energy input signal IGW, the pulse output from the Td-delay and one-shot circuit 42, and the feedback signal SFB that is a result of secondary current comparison. The feedback signal SFB is at a LOW level when the detection signal is above the upper-limit threshold, and at a HIGH level when the detection signal is below the lower limit threshold. That is, while the energy input signal IGW is being output and the pulse is being output from the Td-delay and one-shot circuit 42, the discharge continuation switch SW2 is on when the secondary current I2 is below the lower limit threshold, and the discharge continuation switch SW2 is off when the secondary current I2 is above the upper limit threshold, which enables the energy input operation to be performed.

When the discharge continuation switch SW2 is off in the switching operation, the freewheeling current switch SW3 is being driven on, which allows a freewheeling current to flow through the sub-primary coil 21*b*. This can prevent a sharp drop in the secondary current.

The signal separation circuitry 5 will now be described in detail with reference to FIGS. 3 and 4.

Figure 3:
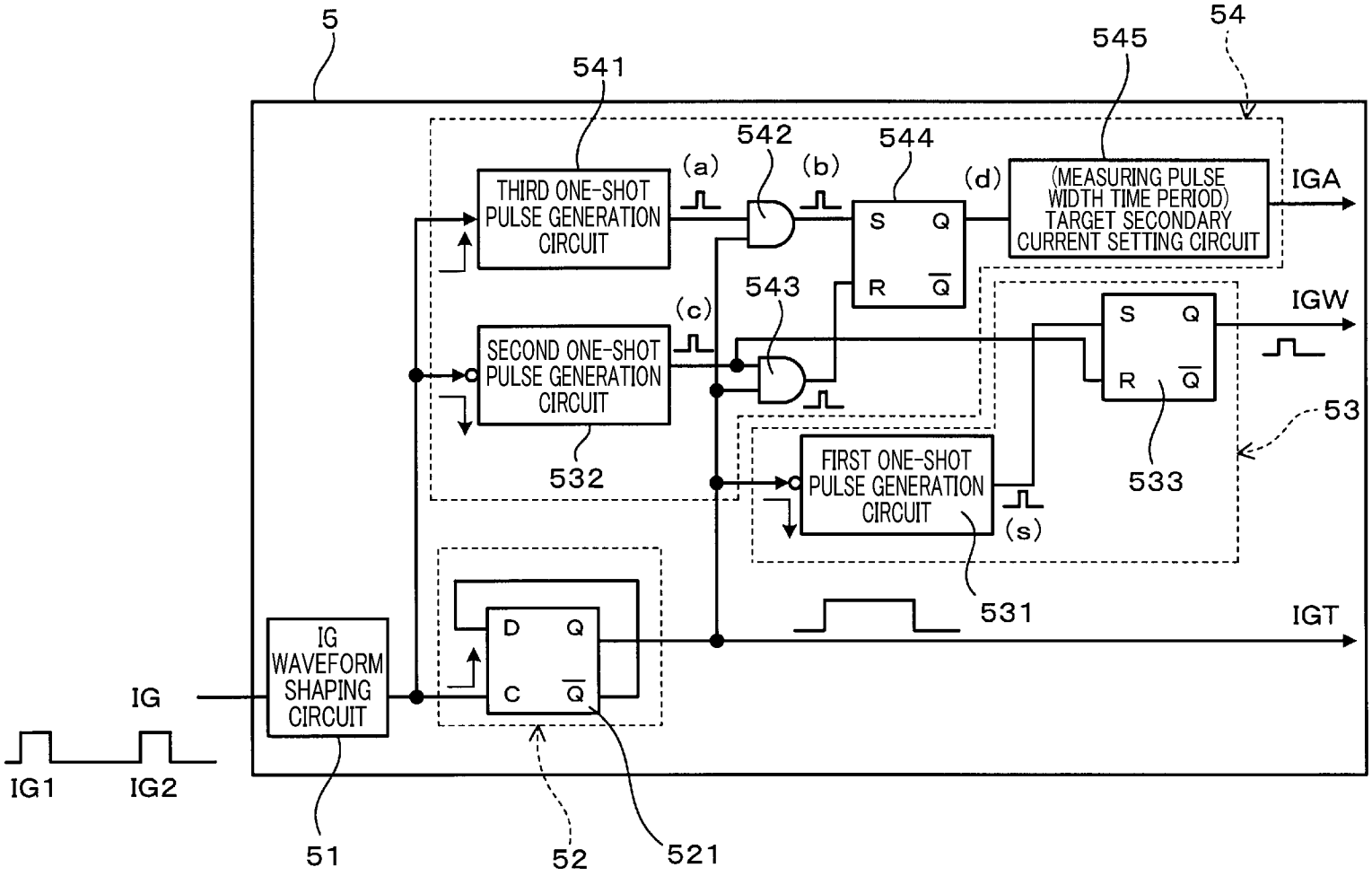
FIG. 3 is a schematic circuit diagram of signal separation circuitry of the ignition device according to the first embodiment.

In FIG. 3, the signal separation circuitry 5 includes an IG waveform shaping circuit 51, an IGT generator 52 configured to generate the main ignition signal IGT, an IGW generator 53 configured to generate the energy input signal IGW, and an IGA generator 54 configured to generalate the target secondary current command signal IGA.

The ignition control signal IG input to the signal separation circuitry 5 is filtered in the IG waveform shaping circuit 51. The first signal IG1 and the second signal IG2, each having a square wave shape with noise removed, are output to each of the IGT generator 52, the IGW generator 53, and the IGA generator 54.

In the present embodiment, the IGA generator 54 generates a target secondary current command signal IGA based on a pulse width of the first signal IG1 and indicates a target secondary current value I2*tgt*. As illustrated in FIG. 4, the ignition control signal IG includes the first signal IG1 and the second signal IG2, where the first signal IG1 is output at the rising edge of the ignition control signal IG and the second signal IG2 is output after the falling edge of the first signal IG1. The target secondary current value I2*tgt* may be changed by changing the pulse width of the first signal IG1.

Figure 4:
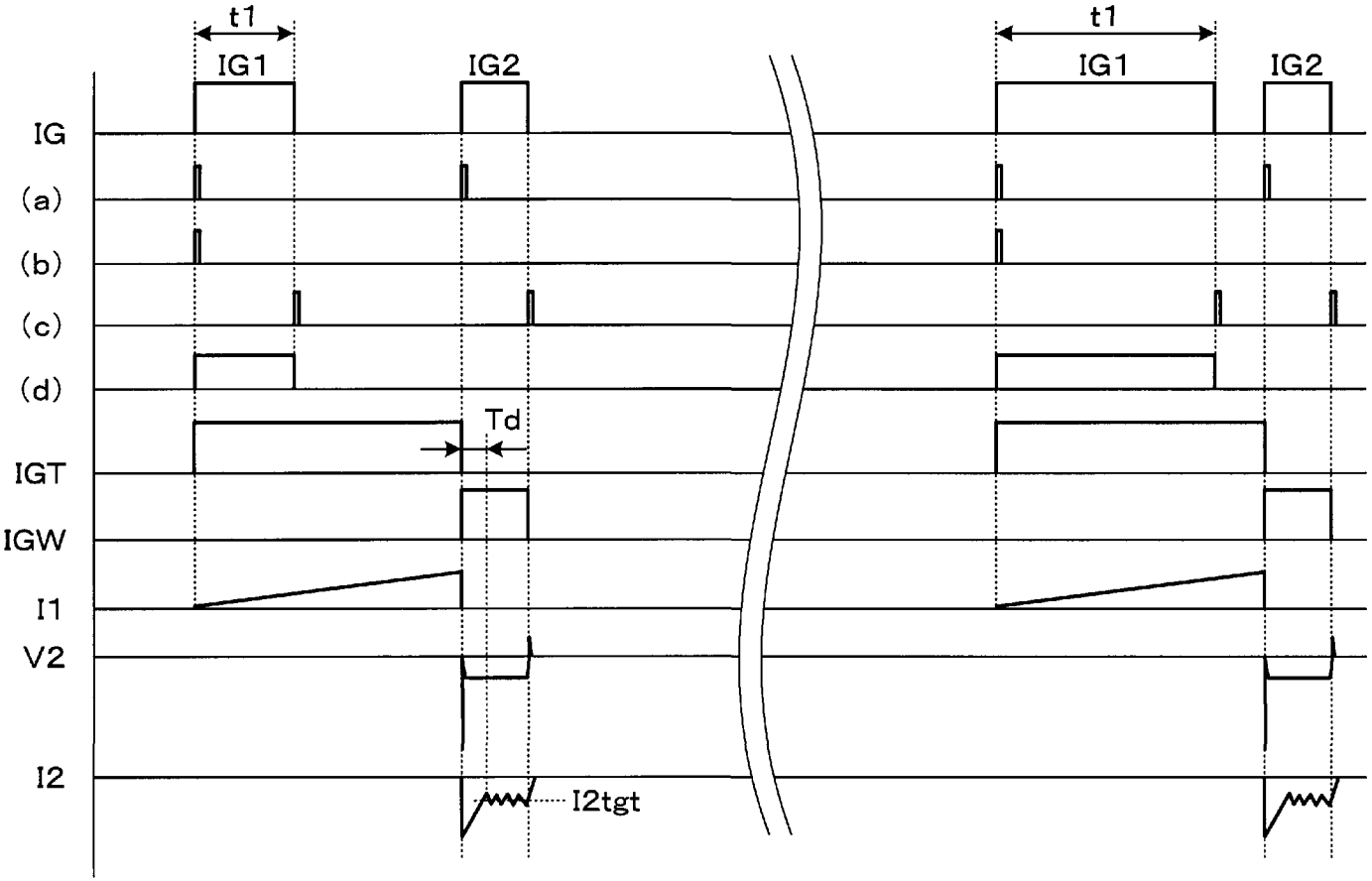
FIG. 4 is a timing chart illustrating a relationship between the ignition control signal, various signals generated in the signal separation circuitry and the progression of the main ignition operation and the energy input operation according to the first embodiment.

FIG. 4 illustrates waveforms of signals output from various components illustrated in FIG. 3 and example transitions of the primary current I1, the secondary voltage V2, and the secondary current I2 of the ignition coil 2.

The IGT generator 52 includes a D flip-flop 521. The output terminal of the IG waveform shaping circuit 51 is connected to the clock terminal of the D flip-flop 521 (referred to as C terminal). The inverting output terminal (referred to as Q bar terminal) is connected to the data terminal (referred to as D terminal) such that an output from the output terminal (referred to as Q terminal) is inverted and input to the D terminal. In an initial state, the Q terminal is at a LOW level and the D terminal is at a HIGH level. In this configuration, when the ignition control signal IG is input to the C terminal, a signal level on the D terminal is latched and a HIGH level signal is output from the Q terminal in synchronization with the rising edge of the first signal IG1. Accordingly, the Q bar terminal is switched to the LOW level and the D terminal is set to the LOW level. Subsequently, upon rising of the second signal IG2, the signal level on the D terminal is latched and the LOW level signal is output from the Q terminal in synchronization with the rising edge of the second signal IG2.

As illustrated in FIG. 4, the main ignition signal IGT rises in synchronization with the rising edge of the first signal IG1 and falls in synchronization with the rising edge of the second signal IG2. That is, a predefined pulse-shaped main ignition signal IGT is generated from the ignition control signal IG, where the pulse width of the main ignition signal IGT is defined by the rising edges of the first signal IG1 and the second signal IG2.

The IGW generator 53 includes a first one-shot pulse generation circuit 531, a second one-shot pulse generation circuit 532, and an RS flip-flop 533. The Q terminal of the D flip-flop 521 is connected to the input terminal of the first one-shot pulse generation circuit 531. The first one-shot pulse generation circuit 531 detects a falling edge of a signal from the Q terminal to generate a predefined one-shot pulse (s). The output terminal of the first one-shot pulse generation circuit 531 is connected to the set terminal (referred to as S terminal) of the RS flip-flop 533. In an initial state, the S terminal is set to a LOW level and the output of the Q terminal is set to LOW level. Having a H level at the S terminal sets the output of the Q terminal to a HIGH level. Having a H level at the R terminal sets the Q output to an LOW level.

The ignition control signal IG after waveform shaping is input to the input terminal of the second one-shot pulse generation circuit 532. The second one-shot pulse generation circuit 532 detects a falling edge of the input signal to generate a predefined one-shot pulse (c). The output terminal of the second one-shot pulse generation circuit 532 is connected to the reset terminal (referred to as R terminal) of the RS flip-flop 533. In an initial state, the output of the second one-shot pulse generation circuit 532 is set to a LOW level. The R and Q terminals of the RS flip-flop 533 are set to a LOW level.

In this state, as illustrated in FIG. 4(*c*), when the ignition control signal IG is input, the one-shot pulse (c) is output from the second one-shot pulse generation circuit 532 to the R terminal of the RS flip-flop 533 in synchronization with the falling edge of the first signal IG1. At this time, the Sand Q terminals are at the LOW level. The output from the Q terminal is unchanged. Subsequently, when the main ignition signal IGT falls in synchronization with the rising edge of the second signal IG2, the one-shot pulse (s) is output from the first one-shot pulse generation circuit 531. This sets the S terminal of the RS flip-flop 533 to the HIGH level and the output from the Q terminal becomes a HIGH level. Thus, the energy input signal IGW rises.

The one-shot pulse (c) is again output from the second one-shot pulse generation circuit 532 in synchronization with the falling edge of the second signal IG2. This sets the R terminal of the RS flip-flop 533 to the H-level and resets the Q terminal to the LOW level. The energy input signal IGW falls accordingly.

In this way, as illustrated in FIG. 4, the energy input signal IGW defined by the rising and falling edges of the second signal IG2 is generated.

The one-shot pulse (c) and the one-shot pulse (s) output from the first one-shot pulse generation circuit 531 and the second one-shot pulse generation circuit 532, respectively, have a shorter signal width than the first signal IG1 and the second signal IG2. In addition, a width of each of the one-shot pulse (c) and the one-shot pulse (s) may be appropriately set within a range, e.g., a range of 10-180 microseconds, above a pulse width range in which the RS flip-flop 533 and RS flip-flop 544 can be driven.

The IGA generator 54 includes a third one-shot pulse generation circuit 541, a first AND gate 542, a second AND gate 543, an RS flip-flop 544, and a target secondary current setting circuit 545. The ignition control signal IG after waveform shaping is input to the input terminal of the third one-shot pulse generation circuit 541. The third one-shot pulse generation circuit 541 detects arising edge of a signal to generate a predefined one-shot pulse (a). The output terminal of the third one-shot pulse generation circuit 541 is connected to one of the input terminals of the first AND gate 542. The Q terminal of the D flip-flop 521 is connected to the other one of the input terminals of the first AND gate 542. The output terminal of the first AND gate 542 is connected to the S terminal RS of the flip-flop 544. In an initial state, the S and Q terminals are set to a LOW level.

The one-shot pulse (a) output from the third one-shot pulse generation circuit 541 has a shorter signal width than the first signal IG1 and the second signal IG2. In addition, a width of the one-shot pulse (a) may be appropriately set within a range, e.g., a range of 10-180 microseconds, above a pulse width range in which the RS flip-flop 544 can be driven.

The output terminal of the second one-shot pulse generation circuit 532 is connected to one of the input terminals of the second AND gate 543. The Q terminal of the D flip-flop 521 is connected to the other one of the input terminals of the second AND gate 543. The output terminal of the second AND gate 543 is connected to the R terminal of the RS flip-flop 544. In an initial state, the R and Q terminals are set a LOW level.

In this state, as illustrated in FIGS. 4(*a*), 4(*b*), and 4(*d*), when the ignition control signal IG is input, the one-shot pulse (a) is output from the third one-shot pulse generation circuit 541 to one of the input terminals of the first AND gate 542 in synchronization with the rising edge of the first signal IG1. The output from the Q terminal of the D flip-flop 521 becomes a HIGH level and input to the other one of the input terminals of the first AND gate 542, which causes the first AND gate 542 to open and a one-shot pulse (b) to be output. This sets the S terminal of the RS flip-flop 544 to a HIGH level and thus causes an output signal (d) from the Q terminal to rise to a HIGH level.

Subsequently, the one-shot pulse (c) is output from the second one-shot pulse generation circuit 532 to one of the input terminals of the second AND gate 543 in synchronization with the falling edge of the first signal IG1. The output from the Q terminal of the D flip-flop 521 becomes a HIGH level and input to the other one of the input terminals of the second AND gate 543, which causes the second AND gate 543 to open. Thus, the R terminal of the RS flip-flop 544 is set to a HIGH level and the Q terminal of the RS flip-flop 544 is reset to a LOW level. That is, an output signal (d) from the Q terminal falls to a LOW level.

The output signal (d) is a pulse signal of a specific width corresponding to the target secondary current command signal IGA. This pulse width is defined by the rising edge and the falling edge of the first signal IG1 and indicates the target secondary current value I2*tgt*. Therefore, in the IGA generator 54, the target secondary current setting circuit 545 captures the output signal (d) and measures a pulse width time period t1 corresponding to the pulse width of the output signal (d), and based on the measured pulse width time period t1, sets the target secondary current value I2*tgt*.

The following table 1 shows an example correspondence between a range of pulse width time period t1 and an absolute value of the target secondary current value I2*tgt*. The target secondary current value I2*tgt* is changed in four steps depending on the magnitude of pulse width time period t. More specifically, for t1 below 0.2 milliseconds (ms), the target secondary current value I2*tgt* is set to 150 mA. The target secondary current value I2*tgt* is decremented by 30 mA every 0.2 milliseconds. For t1 equal to or greater than 0.8 milliseconds, the energy input operation is not performed. The target secondary current value I2*tgt* is not set.

TABLE 1

| t1 | I2tgt |
|---|---|
| 0 ms < t1 < 0.2 ms | 150 mA |
| 0.2 ms ≤ t1 < 0.4 ms | 120 mA |
| 0.4 ms ≤ t1 < 0.6 ms | 90 mA |
| 0.6 ms ≤ t1 < 0.8 ms | 60 mA |
| 0.8 ms ≤ t1 | NO ENERGY INPUT OPERATION |

The target secondary current setting circuit 545 includes a pulse width time period measurement circuit configured to measure a pulse width of the output signal (d), for example, as a time period in which the HIGH level signal is being output. The target secondary current setting circuit 545 converts the measured pulse width time period t1 into a target secondary current value I2*tgt* and outputs the target secondary current value I2*tgt* as a target secondary current command signal IGA. Measurement of the pulse width may be implemented by ANDing an output from a known time pulse generator with the output from the Q terminal of the RS flip-flop 544 and counting the number of pulses that have passed thought an AND circuit.

In this way, the target secondary current command signal IGA defined by the rising edge and the falling edge of the first signal IG1 is generated.

As illustrated in FIG. 4, upon generation of the main ignition signal IGT, the main ignition drive circuit 31 drives the main ignition switch SW1 on to initiate energization of the main primary coil 21*a* while the discharge continuation switch SW2 and the freewheeling current switch SW3 are off, which causes the primary current I1 to gradually increase. Upon interruption of the primary current I1 at the falling edge of the main ignition signal IGT, a high secondary voltage V2 is generated in the secondary coil 22, causing a discharge in the spark gap G of the spark plug P, whereby a secondary current I2 flows through the secondary coil 22. In addition, generation of the energy input signal IGW and the target secondary current command signal IGA causes the discharge continuation switch SW2 and the freewheeling current switch SW3 to be driven on after a predefined delay time Td and at a timing when a result of ANDing with the feedback signal SFB becomes true, whereby the sub-primary coil 21*b* is energized and the secondary current I2 is superposed. This enables continuation of the spark discharge. The discharge energy to be superposed is indicated by the target secondary current command signal IGA. The secondary current value I2*tgt* is feedback controlled to be the target secondary current value I2*tgt*.

In the present embodiment, only the ignition control signal IG needs to be transmitted from the engine ECU to the ignition device 10, which can minimize the number of signal terminals of respective devices and the number of signal lines to be connected between these devices. This allows the energy input operation following the main ignition operation to be controlled in an optimal manner and thus leads to a small-sized and high-performance ignition control device 1 for the internal-combustion engine.

In addition, setting a pulse width of the one-shot pulse signal S1 from the Td-delay and one-shot circuit 42 to a maximum period allowable for energy input allows the energy input operation to be terminated in the event where the second signal IG2 is fixed at a HIGH level during the signal width or where the signal width of the second signal IG2 becomes much larger than expected, enabling protection of the ignition device 10.

In the present embodiment, using, as pulse-waveform information of the first signal IG1, the pulse width time period (or pulse duration) t1 corresponding to the pulse width of the first signal IG1 has been described. In an alternative embodiment, waveform information other than the pulse width may be used. For example, as described later, the target secondary current command signal IGA that indicates the target secondary current value I2*tgt* may be generated based on the number of times (=n) the first signal IG1 is output, an output signal level Vs of the first signal IG1, or a duty cycle T2/T1 of the first signal IG1 or the like within a prescribed time period t2, as pulse-waveform information of the first signal IG1.

Second Embodiment

An ignition control device for an internal-combustion engine according to a second embodiment will now be described with reference to FIGS. 5-6.

In the present embodiment, the number of times the first signal IG1 is output within a predefined time period t2 is used as pulse-waveform information of the first signal IG1 for generating the target secondary current command signal IGA. The ignition control device 1 including the ignition device 10 and the engine ECU 100 is similar as in the first embodiment, except in that the signal separation circuitry 5 of the ignition device 10 is different in configuration. Therefore, the following description is focused on the difference from the first embodiment.

Other structural elements are the same as in the first embodiment. It is noted that those symbols used in the second embodiment and onward that are identical to the symbols used in the previously recited embodiment indicate, unless otherwise specified, structural elements that are the same as those in the previously recited embodiment.

Figure 5:
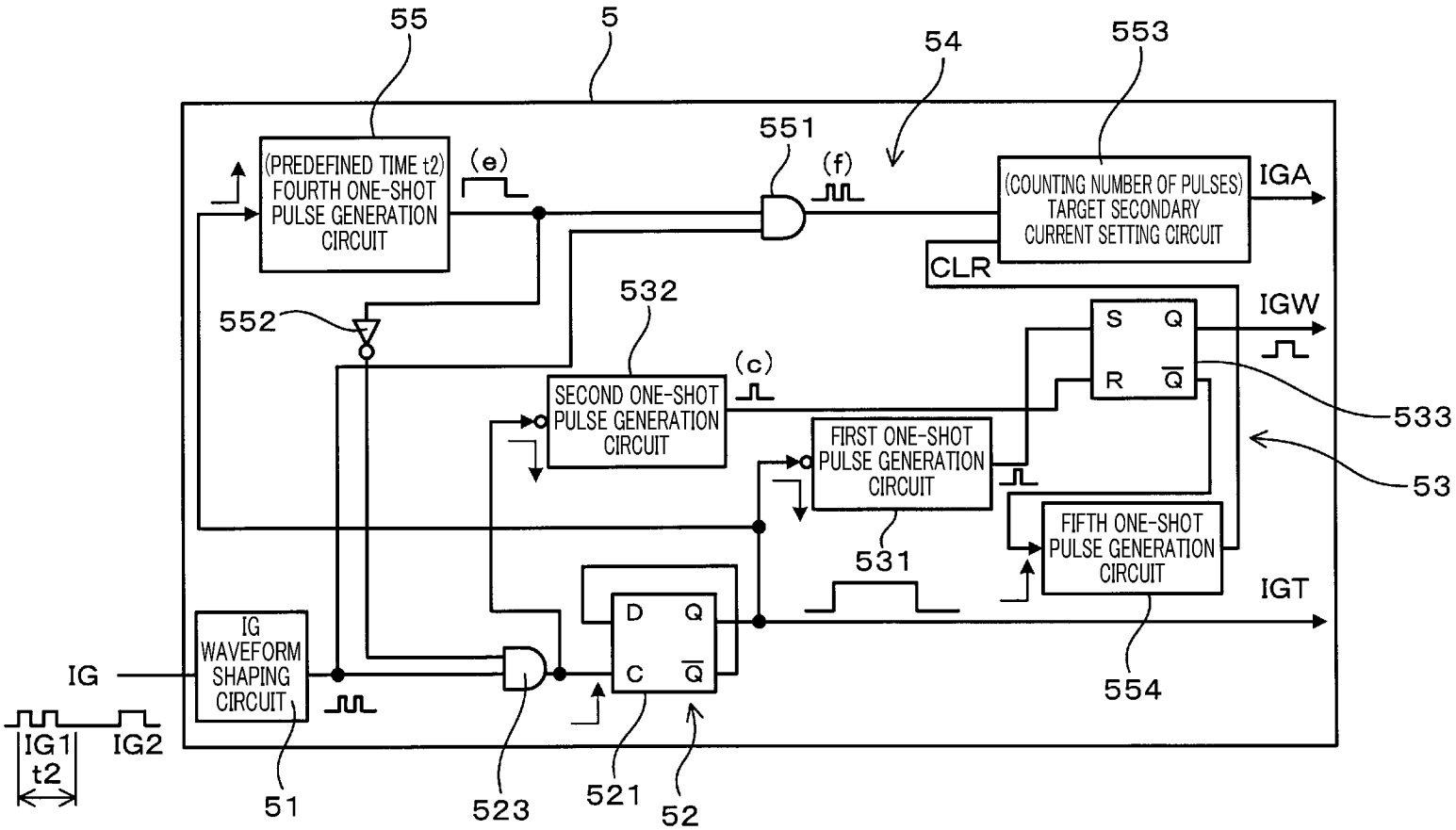
FIG. 5 is a schematic circuit diagram of signal separation circuitry of an ignition device according to a second embodiment.

In FIG. 5, the signal separation circuitry 5 includes the IG waveform shaping circuit 51, the IGT generator 52 configured to generate the main ignition signal IGT, the IGW generator 53 configured to generate the energy input signal IGW, and the IGA generator 54 configured to generalate the target secondary current command signal IGA. In the present embodiment, the IGA generator 54 is configured to count the number of output operations of the first signal IG1 (=n) within the predefined time period t2 and indicate the target secondary current value I2*tgt*. The IGT generator 52 and the IGW generator 53 are similar in configuration as in the first embodiment, and duplicated description thereof will be omitted.

Figure 6:
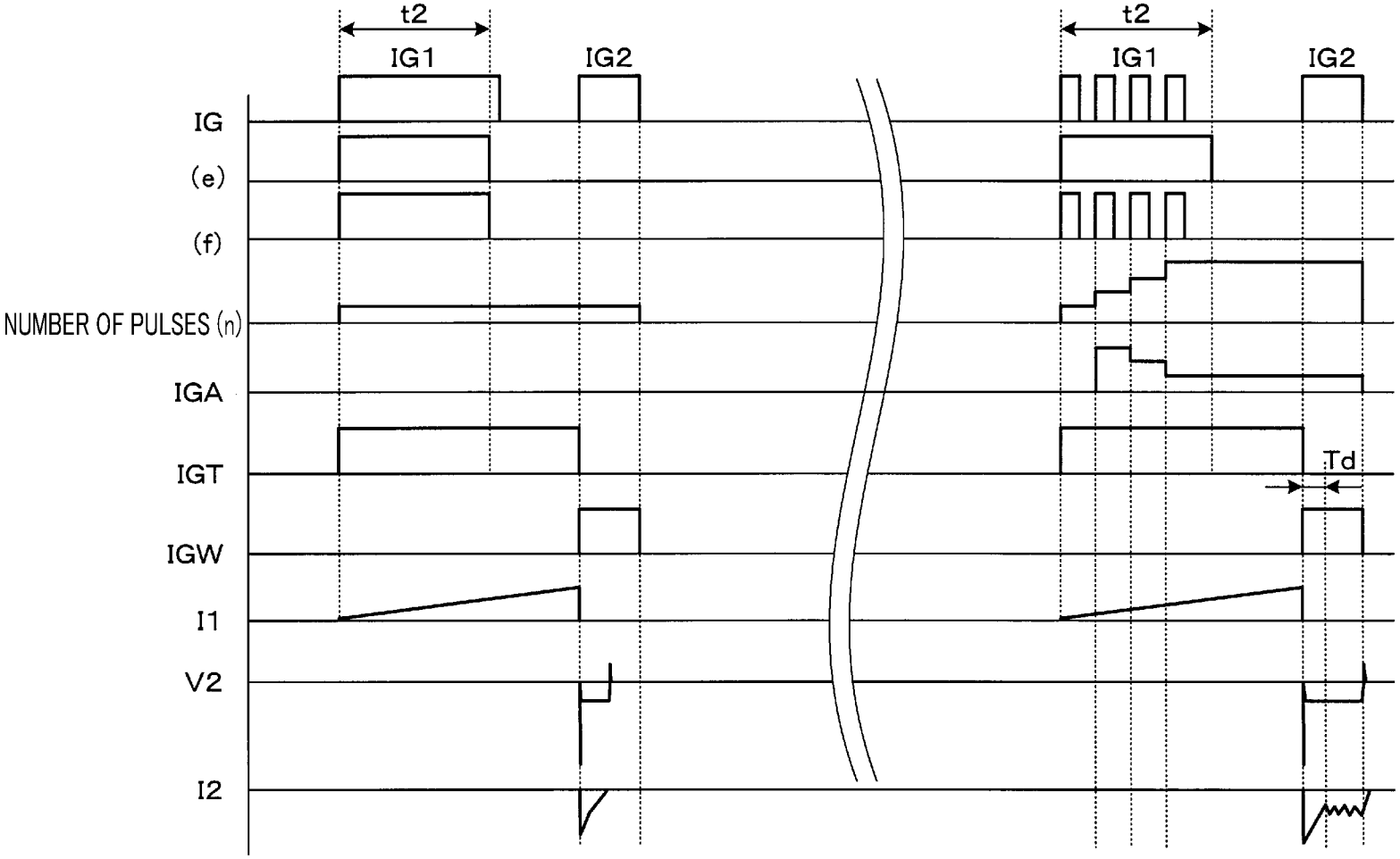
FIG. 6 is a timing chart illustrating a relationship between the ignition control signal and various signals generated in the signal separation circuitry and the progression of the main ignition operation and the energy input operation according to the second embodiment.

As illustrated in FIG. 6, the ignition control signal IG includes the first signal IG1 and the second signal IG2, where the first signal IG1 is a pulse signal to be output within a predefined time period t2 from the rising edge of the ignition control signal IG. Changing the number of output operations of the first signal IG1 (=n) within the predefined time period t2 allows the target secondary current value I2*tgt* to be changed as shown in the table 2 below.

The table 2 shows an example correspondence between the number of output operations of the first signal IG1, n, and the target secondary current value I2*tgt*. In this example, the target secondary current value I2*tgt* is changed in four steps depending on the number of output operations of the first signal IG1. More specifically, if the number of output operations of the first signal IG1 is one (n=1), the target secondary current value I2*tgt* is set to 0 mA, where no energy input operation is to be performed. If the number of output operations of the first signal IG1 is two (n=2), the target secondary current value I2*tgt* is set to 120 mA. The target secondary current value I2*tgt* is decremented by 30 mA each time the number of output operations of the first signal IG1 is incremented by one.

TABLE 2

| n | I2tgt |
|---|---|
| n = 1 | NO ENERGY INPUT OPERATION |
| n = 2 | 120 mA |
| n = 3 | 90 mA |
| n ≥ 4 | 60 mA |

The ignition control signal IG input to the signal separation circuitry 5 is filtered in the IG waveform shaping circuit 51. The first signal IG1 and the second signal IG2, each having a square wave shape with noise removed, are output from the signal separation circuitry 5.

The IGA generator 54 includes a fourth one-shot pulse generation circuit 55 configured to set a predefined time period t2, a third AND gate 551 configured to output the first signal IG1 within the predefined time period t2, a first inverter 552 configured to invert the output from the fourth one-shot pulse generation circuit 55, and a target secondary current setting circuit 553 based on the number of output operations of the first signal IG1.

The main ignition signal IGT is input from the IGT generator 52 to the fourth one-shot pulse generation circuit 55. The fourth one-shot pulse generation circuit 55 detects the rising edge of the main ignition signal IGT and generates and outputs a one-shot pulse (e) corresponding to the predefined time period t2. The one-shot pulse (e) from the fourth one-shot pulse generation circuit 55 and the ignition control signal IG after waveform shaping in the IG waveform shaping circuit 51 are input to the third AND gate 551. The logical AND of these signals yields an output signal (f).

As illustrated in FIG. 6, during the predefined time period t2 in which the one-shot pulse (e) is at a HIGH level, the output level of the output signal (f) is switched in synchronization with the first signal IG1 of the ignition control signal IG. Since, in the left half of FIG. 6, the pulse width of the first signal IG1 is greater than the predefined time period t2, the output signal (f) does not fall within the predefined time period t2 after having risen in synchronization with the rising edge of the first signal IG1, leading to the number of output operations being one (n=1). In cases where, as illustrated in the right half of FIG. 6, the first signal IG1 is output multiple times (e.g., four times) within the predefined time period t2, the output signal (f) is output the same number of times to the input terminal of the target secondary current setting circuit 553.

The target secondary current setting circuit 553 includes, for example, a pulse number measurement circuit configured to measure the number of output operations (n) of the output signal (f) as the number of pulses input to the target secondary current setting circuit 553. The target secondary current setting circuit 553 measures the number of rising edges of the output signal (f) and converts the measured number of output operations into the target secondary current value I2*tgt*, and outputs the target secondary current value I2*tgt* as the target secondary current command signal IGA. In the example illustrated in the left half of FIG. 6 where no energy input operation is to be performed, the output level of the target secondary current command signal IGA is at a zero level. In the right half of FIG. 6, each time the first signal IG1 is output, the output level of the target secondary current command signal IGA steps down toward the preset output level of the target secondary current command signal IGA. In this example, the IGA voltage level corresponding to 60 mA as a preset output level of the target secondary current command signal IGA is reached at the fourth time.

The output terminal of the fifth one-shot pulse generation circuit 554 is connected to the clear terminal CLR of the target secondary current setting circuit 553. The Q bar terminal of the RS flip-flop 533 is connected to the input terminal of the fifth one-shot pulse generation circuit 554. The GW generator 53 is similar in configuration as in the first embodiment. When the Q terminal of the RS flip-flop 533 becomes a LOW level, that is, when the energy input signal IGW falls, the Q bar terminal becomes a HIGH level, which causes the fifth one-shot pulse generation circuit 554 to output a one-shot pulse (referred to as a fifth one-shot pulse output). A measure of the number of pulses is thus cleared, which causes the target secondary current command signal IGA output to be reset. An output pulse duration of the fifth one-shot pulse generation circuit 554 is appropriately set within a range such that a measure of the number of pulses can be cleared, where this range is followed by the subsequent first signal IG1 being input. The output pulse duration of the fifth one-shot pulse generation circuit 554 may be appropriately set within a range of 10-180 microseconds.

The IGT generator 52 includes a fourth AND gate 523 to which the output from the IG waveform shaping circuit 51 and the output from the first inverter 552 are input, and the D flip-flop 521. In an initial state, the output of the first inverter 552 is at a HIGH level. Upon the first signal IG1 being input from the IG waveform shaping circuit 51 to the fourth AND gate 523, the output of the fourth AND gate 523 becomes a high level, which is in turn input to the C terminal of the D flip-flop 521. This causes the output from the Q terminal of the D flip-flop 521 to become a HIGH level and thus causes the main ignition signal IGT to rise.

During the predefined time period t2, the output of the first inverter 552 is at a LOW level. The fourth AND gate 523 is closed and the C terminal of the D flip-flop 521 becomes a LOW level, which allows the main ignition signal IGT to be kept at the HIGH level. The D terminal of the D flip-flop 521 becomes a LOW level. After a lapse of the predefined time period t2, the output of the fourth one-shot pulse generation circuit 55 becomes a LOW level and the output of the first inverter 552 becomes a HIGH level. Upon the second signal IG2 being input, the output of the fourth AND gate 523 becomes a HIGH level and is input to C terminal of the D flip-flop 521. This causes the output from the Q terminal of the D flip-flop 521 to become a LOW level. Thus, the main ignition signal IGT falls.

Thus, also in the present embodiment, the main ignition signal IGT defined by the rising edges of the first signal IG1 and the second signal IG is generated. Interruption of the primary current I1 after energization of the primary coil 21*a* induces a high secondary voltage V2, causing a flow of the secondary current I2. If, as illustrated in the left half of FIG. 6, the target secondary current command signal IGA is at a zero level where the energy input operation is not performed, the sub-primary coil 21*b* is not energized. If the target secondary current command signal IGA directs the energy input operation to be performed, the sub-primary coil 21*b* is energized after a lapse of the predefined delay time Td. Then, the secondary current I2 is superposed and feedback controlled.

This allows the energy input operation following the main ignition operation to be controlled in an optimal manner and thus leads to a small-sized and high-performance ignition control device 1 for the internal-combustion engine.

Third Embodiment

The ignition control device for the internal-combustion engine according to a third embodiment will now be described with reference to FIGS. 7 and 8.

In the present embodiment, an output signal level Vs of the first signal IG1 is used as pulse-waveform information of the first signal IG1 for generating the target secondary current command signal IGA. The ignition control device 1 including the ignition device 10 and the engine ECU 100 is similar as in the first embodiment, except in that the signal separation circuitry 5 of the ignition device 10 is different in configuration. Therefore, the following description is focused on the difference from the first embodiment.

Figure 7:
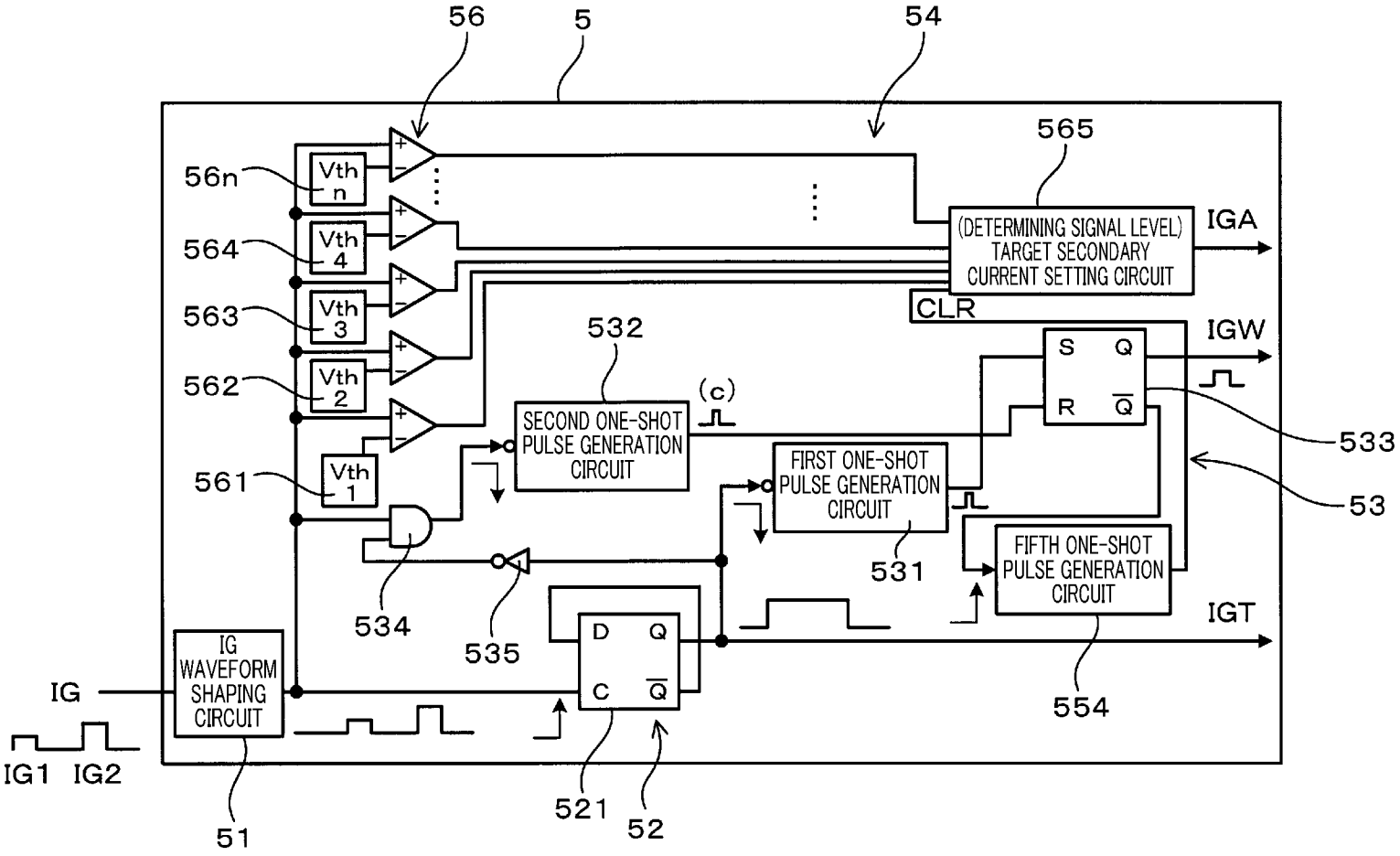
FIG. 7 is a schematic circuit diagram of signal separation circuitry of an ignition device according to a third embodiment.

In FIG. 7, the signal separation circuitry 5 includes the IG waveform shaping circuit 51, the IGT generator 52 configured to generate the main ignition signal IGT, the IGW generator 53 configured to generate the energy input signal IGW, and the IGA generator 54 configured to generalate the target secondary current command signal IGA. In the present embodiment, the target secondary current value I2*tgt* is indicated by changing the output signal level Vs of the first signal IG1. The IGT generator 52 and the IGW generator 53 are similar as in the first embodiment and duplicated description thereof will therefore be omitted.

Figure 8:
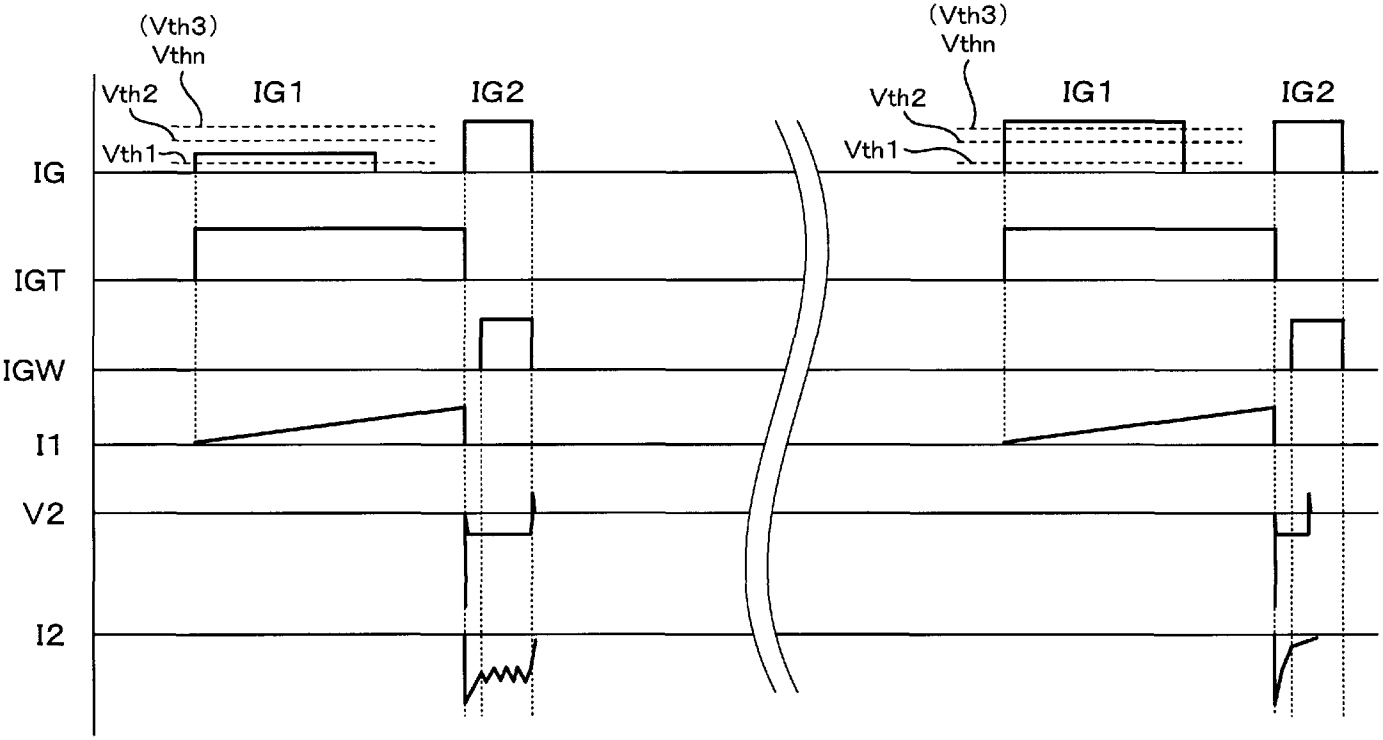
FIG. 8 is a timing chart illustrating a relationship between the ignition control signal and various signals generated in the signal separation circuitry and the progression of the main ignition operation and the energy input operation according to the third embodiment.

As illustrated in FIG. 8, the ignition control signal IG includes the first signal IG1 and the second signal IG2, where the output signal level Vs of the first signal IG1 is settable to any one of a plurality of output voltage levels. A plurality of output voltage levels may be set such that there are one or more output voltage levels between a maximum level value equivalent to that of the second signal IG2 and a minimum level that is set to be detectable. More specifically, given a plurality of threshold voltages Vth1-Vthn, the output voltage level may be determined by comparing the output voltage level with each of the plurality of threshold voltages Vth1-Vthn. Based on a result of comparison, the target secondary current value I2*tgt* is indicated, as shown in the table 3 below.

The table 3 shows an example correspondence between the output signal level Vs of the first signal IG1 and the target secondary current value I2*tgt*. A plurality of output signal levels Vs of the first signal IG1 are set depending on the plurality of threshold voltages Vth1-Vthn. In this example where n=3, the target secondary current value I2*tgt* is changed in four steps. More specifically, if the output signal level Vs of the first signal IG1 is higher than Vth3, the target secondary current value I2*tgt* is set to 0 mA, where no energy input operation is to be performed. If the output signal level Vs of the first signal IG1 is higher than Vth2 but equal to or lower than Vth4, the target secondary current command signal IGA is set to a voltage level corresponding to a target secondary current value I2*tgt* set to 120 mA. The target secondary current value I2*tgt* is decremented by 30 mA with every decrement in n.

TABLE 3

| Vs | I2tgt |
|---|---|
| Vs > Vth3 (Vthn) | NO ENERGY INPUT OPERATION |
| Vth3 ≥ Vs > Vth2 | 120 mA |
| Vth2 ≥ Vs > Vth1 | 90 mA |
| Vth1 ≥ Vs | 60 mA |

The ignition control signal IG input to the signal separation circuitry 5 is filtered in the IG waveform shaping circuit 51. The first signal IG1 and the second signal IG2, each having a square wave shape with noise removed, are output from the signal separation circuitry 5. The IGA generator 54 includes a comparison circuit 56 for comparing the output signal level Vs of the first signal IG1 with the plurality of threshold voltages Vth1-Vthn, and a target secondary current setting circuit 565 based on the output signal level Vs of the first signal IG1.

The comparison circuit 56 includes a plurality of comparators 561-56*n* for comparing the output signal level Vs of the first signal IG1 with the plurality of threshold voltages Vth1-Vthn. The plurality of comparators 561-56*n* are connected in parallel with each other. For each of the plurality of comparators 561-56*n*, a corresponding one of the plurality of threshold voltages Vth1-Vthn is connected to the inverting input terminal and the first signal IG1 is input to the non-inverting input terminal. Each of the plurality of comparators 561-56*n* outputs a HIGH level comparison result signal if the output signal level Vs of the first signal IG1 input is higher than a corresponding one of the threshold voltages Vth1-Vthn. The target secondary current setting circuit 565 includes a determination circuit configured to determine the output signal level Vs of the first signal IG1 based on comparison result signals from the comparators 561-56*n*, converts the output signal level Vs determined into the target secondary current value I2*tgt*, and outputs the target secondary current value I2*tgt* as the target secondary current command signal IGA. As an example, a determination of the output signal level Vs of the first signal IG1 based on comparison result signals may be made by selecting the output level of the target secondary current command signal IGA in response to a logical value of comparison results of the comparators 561-56*n* combining logic circuits or using a known multiplexer circuit.

The IGW generator 53 includes the first one-shot pulse generation circuit 531, the second one-shot pulse generation circuit 532, the RS flip-flop 533, a fifth AND gate 534, and a second inverter 535. The output from the second inverter 535 and the output from the IG waveform shaping circuit 51 are input to the fifth AND gate 534. A signal based on the logical AND of these outputs is input to the second one-shot pulse generation circuit 532. The IGT generator 52 is similar in configuration as in the first embodiment. The output from the Q terminal of the D flip-flop 521 is inverted by the second inverter 535 and input to the fifth AND gate 534.

An output pulse duration of each of the first one-shot pulse generation circuit 531 and the second one-shot pulse generation circuit 532 may be set in a similar manner as in the first embodiment.

In an initial state, the Q terminal of the D flip-flop 521 is at a LOW level. The output from the Q terminal of the D flip-flop 521 becomes a HIGH level at the rising edge of the first signal IG1 and becomes a LOW level at the rising edge of the second signal IG2. The main ignition signal IGT is thus output in a similar manner as in the first embodiment. The RS flip-flop 533 is set as in the first embodiment, which causes initiation of output of the energy input signal IGW. When the output from the Q terminal of the D flip-flop 521 is at a LOW level, the fifth AND gate 534 is opened by the second inverter 535. The ignition control signal IG is thus input to the second one-shot pulse generation circuit 532. At the falling edge of the second signal IG2, the one-shot pulse (c) is output from the second one-shot pulse generation circuit 532, causing the RS flip-flop 533 to be reset. The output from the Q terminal becomes a LOW level.

With this configuration, as in the first embodiment, regardless of the output signal level of the first signal IG1, the one-shot pulse is output from the first one-shot pulse generation circuit 531 in synchronization with the rising edge of the second signal IG2, that is, in synchronization with the falling edge of the main ignition signal IGT, causing the RS flip-flop 533 to be set. This can initiate output of the energy input signal IGW. Thereafter, the one-shot pulse (c) is output from the second one-shot pulse generation circuit 532 in synchronization with the falling edge of the second signal IG2, causing the output of the RS flip-flop 533 to be reset. This can terminate output of the energy input signal IGW.

The one-shot pulse (c) is also output from the second one-shot pulse generation circuit 532 with a propagation delay time of the output signal from the Q terminal of the D flip-flop 521 from the rising edge of the first signal IG1, which initializes the Q output of the RS flip-flop 533 to a LOW level. Thus, the energy input signal IGW can be reliably cleared at the rising edge of the first signal IG1. The other configurations and operations are similar as in the first embodiment.

A peak value (e.g., the output signal level Vs) of the first signal IG1 and the thresholds (i.e., the threshold voltages Vth1-Vthn) are set by partitioning a range in which the inputs of the D flip-flop 521 and the fifth AND gate 534 are determined to be at a HIGH level. In an alternative embodiment, the peak value and the thresholds may be set not only within this range, but also above and below this range, where a voltage level converter including a voltage converter or a voltage amplifier may be included at inputs of the D flip-flop 521 and the fifth AND gate 534 such that the peak value of the first signal IG1 may be determined at a HIGH level.

Thus, also in the present embodiment, the main ignition signal IGT defined by the rising edges of the first signal IG1 and the second signal IG is generated. Interruption of the primary current I1 after energization of the primary coil 21*a* induces a high secondary voltage V2, causing a flow of the secondary current I2. If, as illustrated in the left half of FIG. 8, the target secondary current command signal IGA (precisely, its voltage level) is between the two threshold voltages Vth1, Vth2, the target secondary current value I2*tgt* is set based on the table 3. The sub-primary coil 21*b* is energized after a lapse of the predefined delay time Td. Then, the secondary current I2 is superposed and feedback controlled. If, as illustrated in the right half of FIG. 8, the target secondary current command signal IGA (precisely, its voltage level) exceeds the maximum threshold voltage Vthn (e.g., Vth3), the target secondary current command signal IGA is set to a zero level where the sub-primary coil 21*b* is not energized.

This allows the energy input operation following the main ignition operation to be controlled in an optimal manner and thus leads to a small-sized and high-performance ignition control device 1 for the internal-combustion engine.

Fourth Embodiment

The ignition control device for the internal-combustion engine according to a fourth embodiment will now be described with reference to FIGS. 9 and 10.

In the present embodiment, a duty cycle T2/T1 of the first signal IG1 is used as pulse-waveform information about the first signal IG1 for generating the target secondary current command signal IGA. The ignition control device 1 including the ignition device 10 and the engine ECU 100 is similar in configuration as in the third embodiment, except in that the signal separation circuitry 5 of the ignition device 10 is different in configuration. Therefore, the following description is focused on the difference from the third embodiment.

Figure 9:
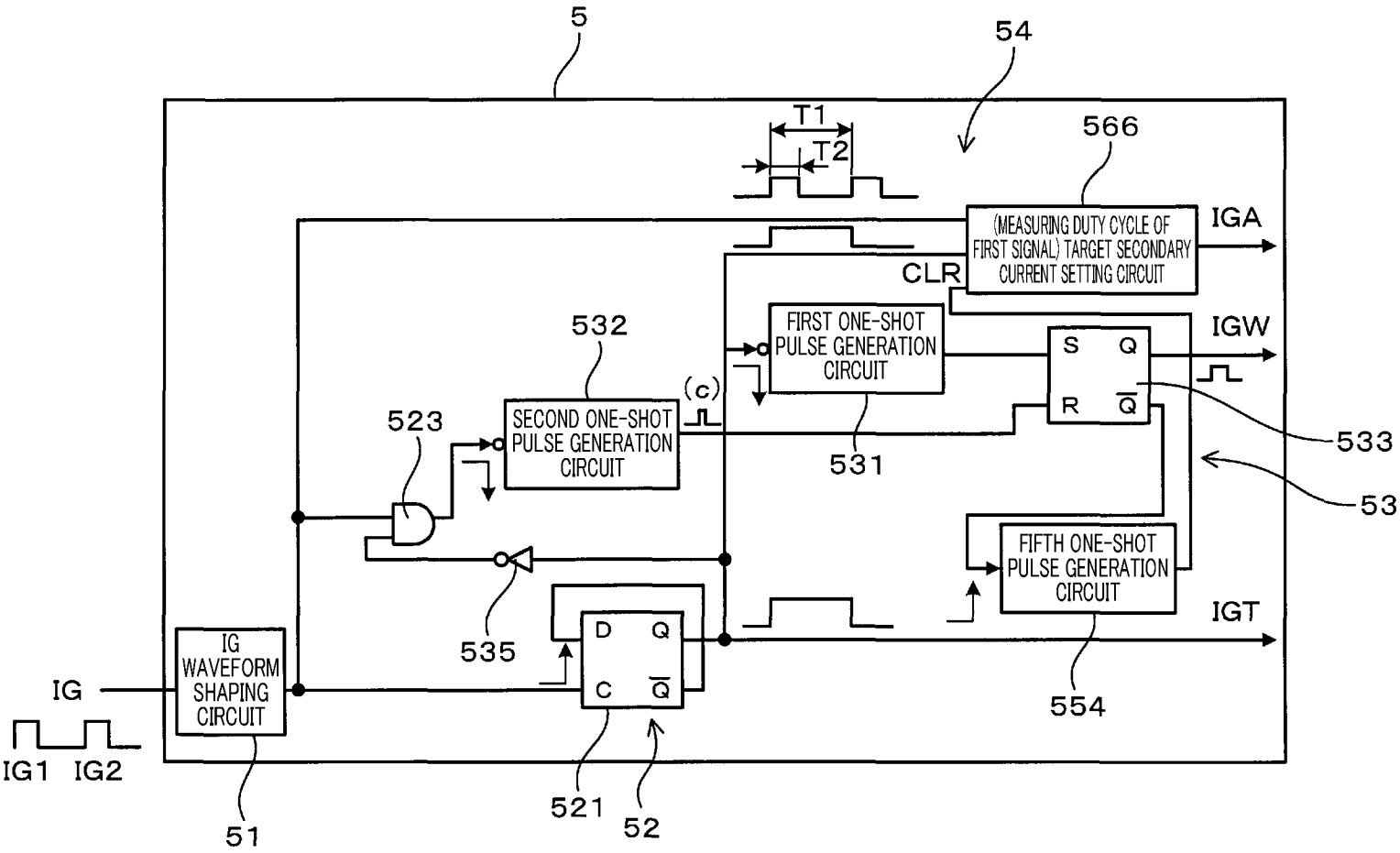
FIG. 9 is a schematic circuit diagram of signal separation circuitry of an ignition device according to a fourth embodiment.

In FIG. 9, the signal separation circuitry 5 includes the IG waveform shaping circuit 51, the IGT generator 52 configured to generate the main ignition signal IGT, the IGW generator 53 configured to generate the energy input signal IGW, and the IGA generator 54 configured to generalate the target secondary current command signal IGA. In the present embodiment, the target secondary current value I2*tgt* is indicated by changing the duty cycle T2/T1 of the first signal IG1. The IGT generator 52 and the IGW generator 53 are similar as in the first embodiment and duplicated description thereof will therefore be omitted.

Figure 10:
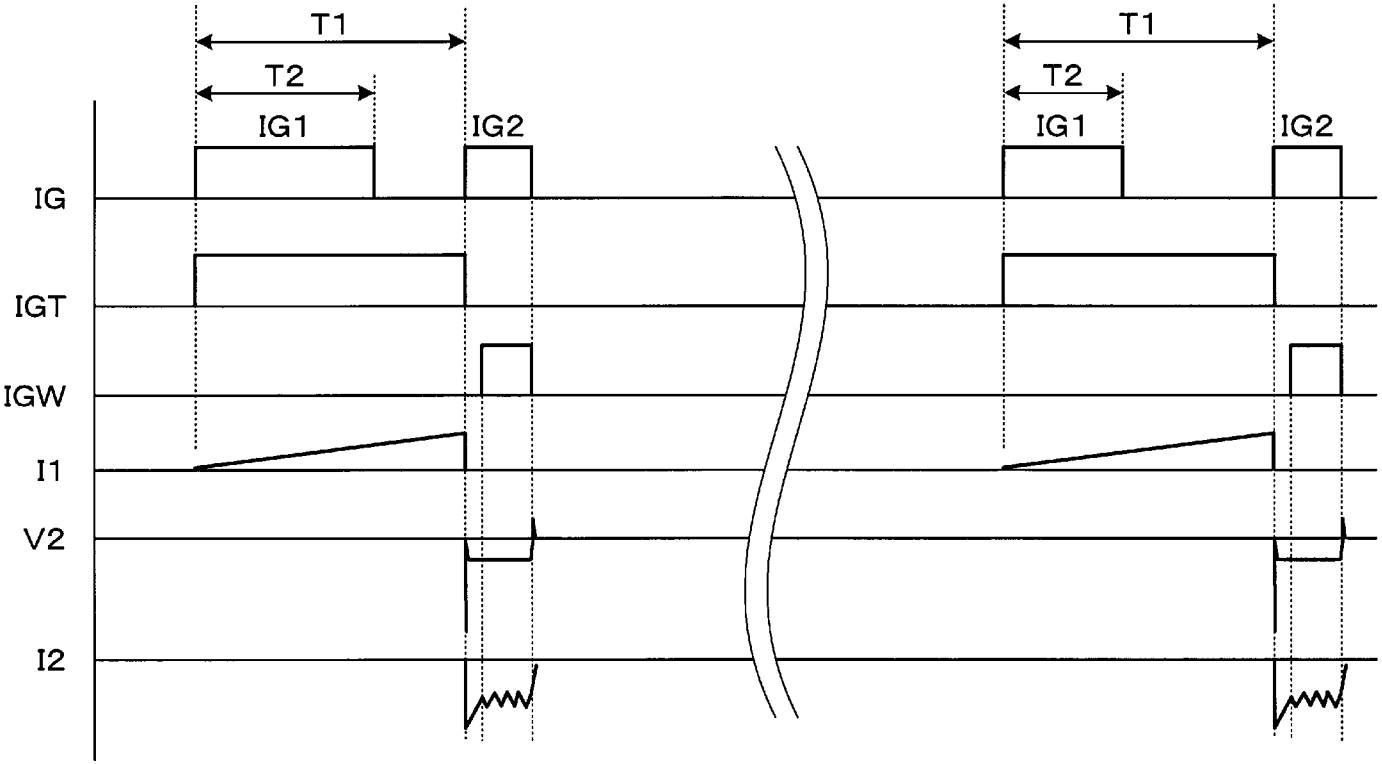
FIG. 10 is a timing chart illustrating a relationship between the ignition control signal and various signals generated in the signal separation circuitry and the progression of the main ignition operation and the energy input operation according to the fourth embodiment.

As illustrated in FIG. 10, the ignition control signal IG includes the first signal IG1 and the second signal IG2, where a duty cycle T2/T1 of the first signal IG1 is a ratio of an output duration T2 of the first signal IG1 to a period T1 of the first signal IG1 (i.e., a time period between the rising edge of the first signal IG1 and the rising edge of the second signal IG2). Setting the duty cycle T2/T1 of the first signal IG1 allows the target secondary current value I2*tgt* to be changed as shown in the Table 4 below.

The Table 4 shows an example correspondence between the duty cycle T2/T1 of the first signal IG1 and the target secondary current value I2*tgt*. A plurality of ranges are set depending on the value of T2/T1. In this example, the target secondary current value I2*tgt* is changed in four steps. More specifically, if T2/T1 is equal to or greater than 75%, the target secondary current command signal IGA is set to a zero level corresponding to a target secondary current value I2*tgt* set to 0 mA, where no energy input operation is to be performed. If T2/T1 is equal to or greater than 50% but less than 75%, the target secondary current command signal IGA is set to a voltage level corresponding to a target secondary current value I2*tgt* set to 120 mA. The target secondary current value I2*tgt* is decremented by 30 mA with every 25% decrease in T2/T1.

TABLE 4

| T2/T1 | I2tgt |
|---|---|
| T2/T1 ≥ 75% | NO ENERGY INPUT OPERATION |
| 75% > T2/T1 ≥ 50% | 120 mA |
| 50% > T2/T1 ≥ 25% | 90 mA |
| 25% > T2/T1 | 60 mA |

The ignition control signal IG input to the signal separation circuitry 5 is filtered in the IG waveform shaping circuit 51. The first signal IG1 and the second signal IG2, each having a square wave shape with noise removed, are output from the signal separation circuitry 5. The IGA generator 54 includes a target secondary current setting circuit 566 based on the duty cycle T2/T1 of the first signal IG1. The output from the IG waveform shaping circuit 51 and the output from the Q terminal of the D flip-flop 521 are input to the target secondary current setting circuit 566. The target secondary current setting circuit 566 measures an output duration T2 of the first signal IG1 from the IG waveform shaping circuit 51 and measures a period T1 of the first signal IG1 from the Q terminal of the D flip-flop 521. Based on the measurements, the target secondary current setting circuit 566 calculates and converts the duty cycle T2/T1 into a target secondary current value I2*tgt* and outputs the target secondary current value I2*tgt* as a target secondary current command signal IGA.

The output duration T2 of the first signal IG1 may be measured by ANDing an output from a known time pulse generator, the ignition control signal IG, and the output from Q terminal of the D flip-flop 521 and counts the number of pulses passing through an AND circuit. The period T1 of the first signal IG1 may be measured by ANDing the output from the time pulse generator and the output from the Q terminal of the D flip-flop 521 and counting the number of pulses passing through the AND circuit. The duty cycle T2/T1 may be calculated by counting the number of times a measure of the period T1 minus a measure of the output duration T2 can be calculated.

Thus, also in the present embodiment, the main ignition signal IGT defined by the rising edges of the first signal IG1 and the second signal IG is generated. Interruption of the primary current I1 after energization of the primary coil 21*a* induces a high secondary voltage V2, causing a flow of the secondary current I2. As illustrated in FIG. 10, the target secondary current value I2*tgt* is set as a function of the duty cycle T2/T1 with reference to the Table 4. After the predefined delay time Td, the sub-primary coil 21*b* is energized. Then, the secondary current I2 is superposed and feedback controlled.

This allows the energy input operation following the main ignition operation to be controlled in an optimal manner and thus leads to a small-sized and high-performance ignition control device 1 for the internal-combustion engine.

Fifth Embodiment

The ignition control device for the internal-combustion engine according to a fifth embodiment will now be described with reference to FIG. 11.

In the above embodiments, the first signal IG1 and the second signal IG2 of the ignition control signal IG are identified based on an order in which the first signal IG1 and the second signal IG2 are input to the ignition device 10 after beginning operation of the ignition control device. In the present embodiment, the first signal IG1 and the second signal IG2 of the ignition control signal IG may be identified based on other information, such as pulse-waveform information.

Figure 11:
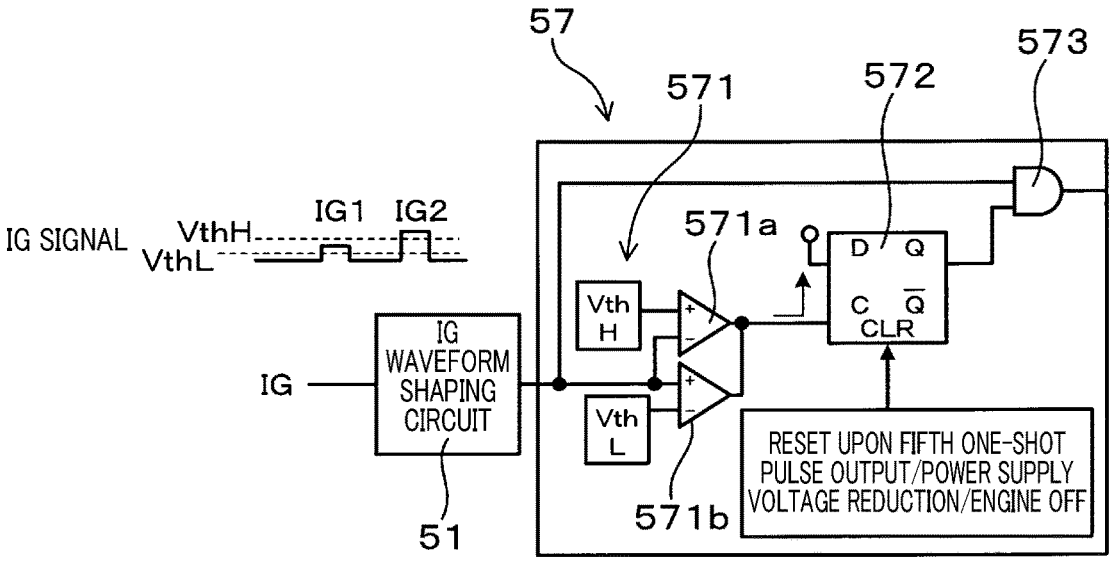
FIG. 11 is a schematic circuit diagram of main part of an ignition device according to a fifth embodiment.

In the present embodiment, as illustrated in FIG. 11, a pulse waveform is set such that output signal levels of the first signal IG1 and the second signal IG2 are different from each other. For example, setting pulse peak values of the first signal IG1 and the second signal IG2 of the ignition control signal IG such that the pulse peak value of the first signal IG1 is less than the pulse peak value of the second signal IG2 and each of the pulse peak values of the first signal IG1 and the second signal IG2 is within a respective one of ranges defined by a predefined upper-limit threshold VthH and a predefined lower limit threshold VthL.

The signal separation circuitry 5 detects the first signal based on a predefined output signal level. More specifically, for identification of the first signal IG1, a first signal determiner 57 may be provided at the subsequent stage to the IG waveform shaping circuit 51 of the ignition device 10. The first signal determiner 57 includes a window comparator 571, a D flip-flop 572, and a sixth AND gate 573. The window comparator 571 includes a comparison circuit 571*a* that compares an input signal to an inverting input terminal with the upper-limit threshold VthH and a comparison circuit 571*b* that compares the input signal to a non-inverting input terminal with the lower-limit threshold vthL. If the input signal level is between the upper-limit threshold VthH and the lower limit threshold VthL, the output signal becomes a HIGH level. The D terminal of the D flip-flop 572 connected to a HIGH level. That is, the D terminal of the D flip-flop 572 is at the HIGH level in an initial state. When the output of the window comparator 571 becomes the HIGH level, the output from the Q terminal becomes a HIGH level.

The output from the IGW waveform shaping circuit 51 and the output from the Q terminal of the D flip-flop 572 are input to the sixth AND gate 573. When the first signal IG1 is input to the window comparator 571, the output from the Q terminal of the D flip-flop 572 becomes the HIGH level and the sixth AND gate 573 opens, which allows the subsequent signals to be transferred to the circuit at the subsequent stage. A reset signal is to be input to the CLR terminal of the D flip-flop 572 when the power-supply voltage is reduced or when the engine is off. Although not shown, a filter circuit or the like may be provided between the output of the window comparator 571 and the C terminal of the D flip-flop 572 to detect that the voltage level of the ignition control signal IG is within the predefined voltage range during a certain time period. This can prevent a false determination from occurring in the event where the voltage level of the ignition control signal IG is within the predefined voltage range during rising of the first signal IG1 and the first signal IG1 accidentally passes through the window comparator 571.

With this configuration, the first signal IG1 can be identified only by inputting one signal. This can reduce a wait time caused by an input latency or determination latency of the first signal IG1 and the second signal IG2 and can thus prevent the delay in the control. In addition, even in the embodiment where the first signal IG1 is identified based on the signal input order, this can prevent occurrence of a malfunction accidentally caused by the second signal IG2 input.

In the present embodiment, each time the D flip-flop 572 is cleared by the fifth one-shot pulse output triggered by the falling edge of the energy input signal IGW, the output signal levels of the first signal IG1 and the second signal IG2 are set to be different from each other. In an alternative embodiment, clearing the D flip-flop 572 by the fifth one-shot pulse output may be canceled. In such an embodiment, the output signal levels of the first signal IG1 and the second signal IG2 may differ from each other only in the first instance of output, and the output signal levels of the first signal IG1 and the second signal IG2 may be set equal to each other in the subsequent instances of output. This is because the first signal IG1 and the second signal IG2 can be identified if there is a difference between output signal levels of pulse waveforms of the first signal IG1 and the second signal IG2 at least in the first instance of output. Therefore, output signal levels of the first signal IG1 in the first instance of output and the first signal IG1 in the subsequent instance of output may be different. This may readily be implemented by setting clear input to the D flip-flop 572 for determination hold so that it assumes a desired behavior.

Sixth Embodiment

Figure 12:
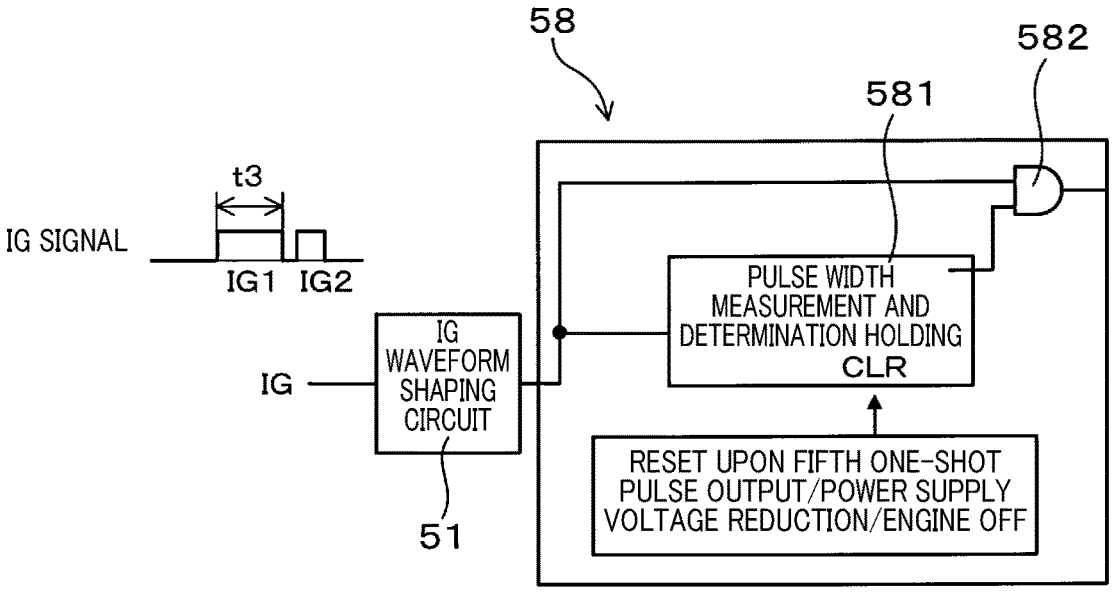
FIG. 12 is a schematic circuit diagram of main part of an ignition device according to a sixth embodiment.

The ignition control device for the internal-combustion engine according to a sixth embodiment will now be described with reference to FIG. 12. In the present embodiment, as illustrated in FIG. 12, pulse waveforms of the first signal IG1 and the second signal IG2 are set such that pulse widths of the first signal IG1 and the second signal IG2 are different from each other. The first signal IG1 is identified using the pulse width as pulse-waveform information. More specifically, as illustrated in FIG. 12, the pulse width of the first signal IG1 is significantly greater than the pulse width of the second signal IG2. For example, the pulse width of the first signal IG1 may be set to a pulse width time period t3 (e.g., around 3 milliseconds) that is greater than a maximum of assumed pulse width time period of the second signal IG2, which facilitates identification of the first signal IG1.

The signal separation circuitry 5 detects the first signal IG1 based on a predefined pulse width time period. More specifically, for identification of the first signal IG1, a second signal determiner 58 may be provided at the subsequent stage to the IG waveform shaping circuit 51 of the ignition device 10. The second signal determiner 58 includes a pulse width determination circuit 581 for pulse width measurement and first-signal determination holding, and a seventh AND gate 582. The output from the IG waveform shaping circuit 51 is input to the pulse width determination circuit 581 and to the seventh AND gate 582. A result of determination by the pulse width determination circuit 581 is cleared when a fifth one-shot pulse is output, when the power is on, or when the engine is off. The output from the pulse width determination circuit 581 becomes a LOW level after being cleared.

The pulse width determination circuit 581 includes, for example, a time-period measurement circuit that measures a time period corresponding to a pulse width of an input signal, and a determination holding circuit. The determination holding circuit determines whether the input signal is the first signal IG1 by comparing a measurement of signal width time period with a time-period threshold that is preset corresponding to the pulse width time period t3, and if detecting the first signal IG1, holds the determination that the input signal is the first signal IG1. Upon output of the first signal IG1 from the waveform shaping circuit 51, pulse width measurement is initiated in the pulse width determination circuit 581. If a measurement of pulse width meets a condition that a measurement of pulse width exceeds the time-period threshold, it is determined that the input signal is the first signal IG1. A reset signal is to be input to the CLR terminal of the pulse width determination circuit 581, for example, when a power-supply voltage is reduced or when the engine is off.

The present embodiment can provide similar advantages as in the fifth embodiment, that is, the first signal IG1 can be identified only by inputting one signal. This can prevent a delay in control and prevent occurrence of a malfunction due to misidentification.

In an alternative embodiment, clearing the pulse width determination circuit 581 by the fifth one-shot pulse output may be canceled. In such an embodiment, the pulse width time period of the first signal IG1 may be set to a value such that the first signal IG1 can be identified at least in the first signal output. No determination to identify the first signal IG1 may be made in the subsequent signal output. Each time the ignition control signal IG is input or every predetermined number of times the ignition control signal IG is input, a determination may be made. This may readily be implemented by setting clearing input to the pulse width determination circuit 581 for determination holding so that it assumes a desired behavior.

Seventh Embodiment

The ignition control device for the internal-combustion engine according to a seventh embodiment will now be described with reference to FIG. 13.

In each of the embodiments set forth above, the target secondary current command signal IGA is generated using the pulse-waveform information of the first signal IG1 of the ignition control signal IG. Additionally, in the present embodiment, the target secondary current command signal IGA during one combustion cycle may be changed using the pulse-waveform information of the second signal IG2 of the ignition control signal IG.

Figure 13:
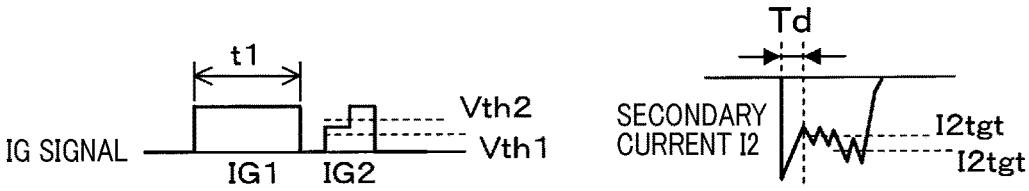
FIG. 13 is a waveform chart of the ignition control signal and a secondary current corresponding to the ignition control signal according to a seventh embodiment.

More specifically, as illustrated in the left half of FIG. 13, the output signal level Vs of the second signal IG2 is settable to any one of a plurality of output voltage levels, thereby allowing the target secondary current value I2*tgt* indicated by the target secondary current command signal IGA to be changed. In such an embodiment, the output signal level Vs2 of the second signal IG2 may further be changed in one signal output. For example, as illustrated in the left half of FIG. 13, in cases where the signal level steps up, the anterior signal level is between the threshold voltages Vth1, Vth2 and the posterior signal level is above the threshold voltage Vth2. This allows the output signal level Vs2 to be determined by sequentially comparing the output signal level Vs2 with the threshold voltages Vth2.

As shown in the following table 5, the target secondary current value I2*tgt* by the output signal level Vs2 is changed within a range of 60-120 mA using a plurality of threshold voltages Vth1-Vthn (e.g., n=3). A determination of the output signal level Vs2 may be made using a comparison circuit similar as in the third embodiment. Also in such an embodiment, the indication of the target secondary current value I2*tgt* by the output signal level Vs2 may be combined with the indication of the target secondary current value I2*tgt* by pulse-waveform information, such as the signal level of the first signal IG1 or the like, where a determination of the output signal level Vs of the first signal IG1 and a determination of the output signal level Vs2 of the second signal IG2 in the present embodiment may be made using the logical AND circuit (not shown) with the main ignition signal IGT. Even if the output signal level Vs2 of the second signal IG2 is the same value as the output signal level Vs of the first signal IG1, the target secondary current value I2*tgt* may be reconfigurable based on the second signal IG2. In an alternative embodiment, to simplify the circuit, the target secondary current value I2*tgt* indicated by the output signal level output signal level Vs and the target secondary current value I2*tgt* indicated by the output signal level Vs2 may be set equal to each other for the threshold voltage Vth.

TABLE 5

| Vs2 | I2tgt |
|---|---|
| Vs2 > Vth3 (Vthn) | 120 mA |
| Vth3 ≥ Vs2 > Vth2 | 100 mA |
| Vth2 ≥ Vs2 > Vth1 | 80 mA |
| Vth1 ≥ Vs2 | 60 mA |

In the present embodiment, generation of each signal at the time the ignition control signal IG is output may be performed in a similar manner as in the above embodiments. For example, as in the first embodiment, the target secondary current command signal IGA may be output based on the pulse signal width of the first signal IG1. The main ignition signal IGT may be generated based on the rising edges of the first signal IG1 and the second signal IG2. In addition, the target secondary current command signal IGA may be generated and updated from the signal level Vs2 of the second signal IG2. The energy input signal IGW may be generated based on the pulse width of the second signal IG2.

With this configuration, the indication of the target secondary current value I2*tgt* when the time energy input operation is performed after the delay time Td is based on the updated target secondary current command signal IGA. The target secondary current command signal IGA is updated each time the output signal level Vs2 steps up, which causes the target secondary current value I2*tgt* to be changed. This leads increased secondary current I2, as illustrated in the right half of FIG. 13.

In the present embodiment, when necessary discharge energy changes upon changes in engine operating condition, the target secondary current command signal IGA may be changed during one combustion cycle, which allows just enough discharge energy to be input and enables stable continuation of the spark discharge.

Eighth Embodiment

The ignition control device for the internal-combustion engine according to an eighth embodiment will now be described with reference to FIG. 14.

Also in the present embodiment, the ignition control signal IG is separated into three signals by the signal separation circuitry 5 of the ignition device 10 and output to various circuits to ignite the spark plug P. The configuration of the energy input circuitry 4 for preforming the energy input operation to the ignition coil 2 is not limited to the configuration in the first embodiment, but may be any configuration such that the secondary current I2 of the same polarity can be superposed by preforming the energy input operation after performing the main ignition operation. The configurations and operations of the ignition coil 2 and the ignition device 10 are similar to those of the first embodiment. Therefore, the following description is focused on the difference from the first embodiment.

Figure 14:
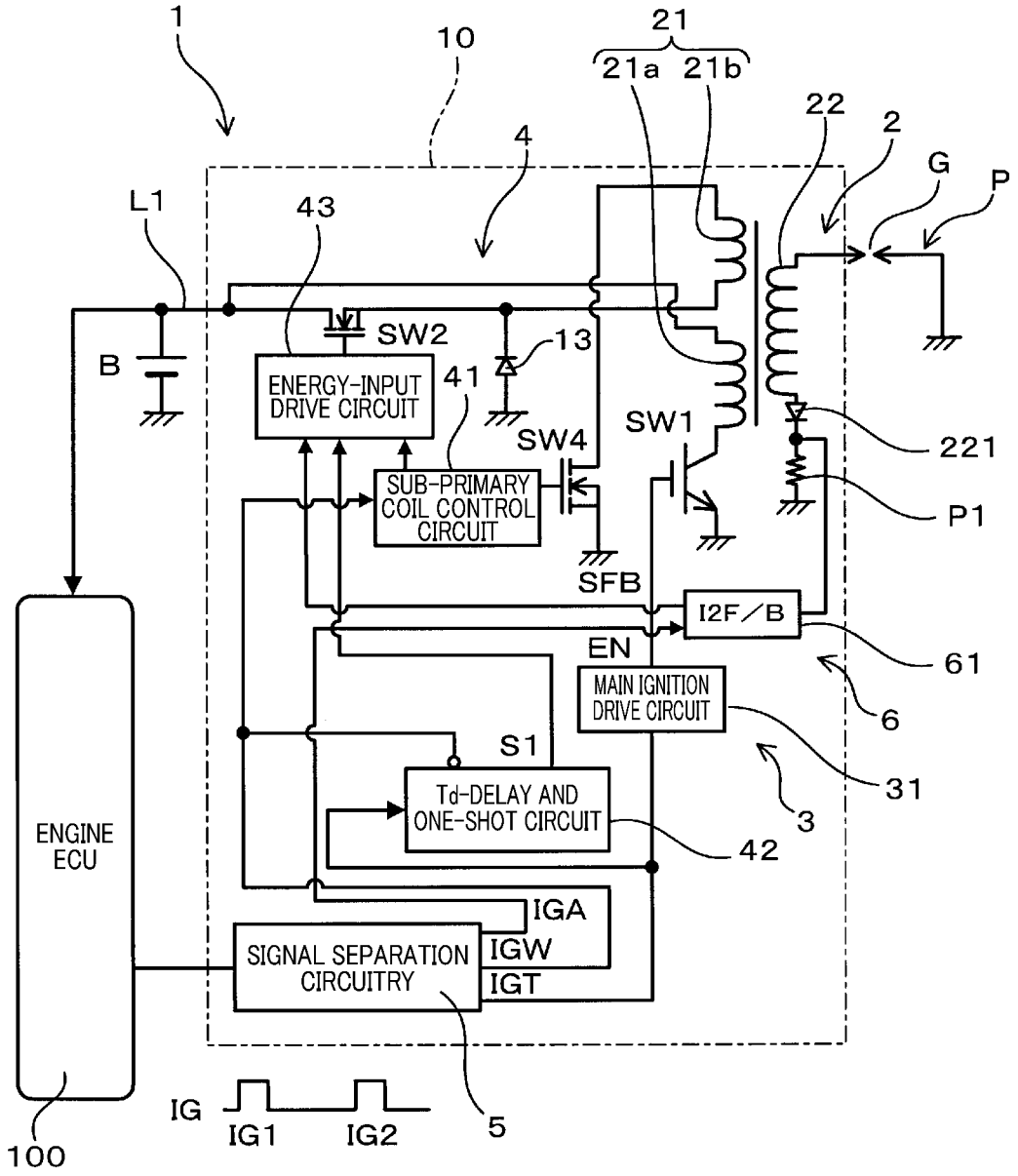
FIG. 14 is a schematic circuit diagram of an ignition control device for an internal-combustion engine according to an eighth embodiment.

As illustrated in FIG. 14, the ignition coil 2 includes the main primary coil 21*a* and the sub-primary coil 21*b*. The first end of the main primary coil 21*a* is connected to the power line L1 and the second end of the main primary coil 21*a* is connected to ground via the main ignition switch SW1. The first end of the sub-primary coil 21*b* is connected to the power line L1 and the second end of the sub-primary coil 21*b* is connected to ground via the switching element for enabling energization (referred to as an energization enabling switch) SW4. The energization enabling switch SW4 is off during the main ignition operation. Energization is enabled while the energy input signal IGW is at a HIGH level. The energization enabling switch SW4 is driven on by the drive signal from the sub-primary coil control circuit 41.

The discharge continuation switch SW2 is provided along the power line L1 between the sub-primary coil 21*b* and a connection point of the main primary coil 21*a* and the power line L1. A fourth diode 13 is provided between the discharge continuation switch SW2 and the sub-primary coil 21*b*. An anode terminal of the fourth diode 13 is connected to ground. A cathode terminal of the fourth diode 13 is connected to the power line L1. A freewheeling current flows while the discharge continuation switch SW2 is off and a current flowing through the sub-primary coil 21*b* changes slowly, which can prevent a sharp drop in the secondary current I2.

The discharge continuation switch SW2 is driven on and off by the switch drive circuit for the energy input operation (referred to as an energy-input drive circuit) 43. Based on the command signal from the sub-primary coil control circuit 41 and the one-shot pulse signal S1 from the Td-delay and one-shot circuit 42, and the feedback signal SFB, the energy-input drive circuit 43 drives on and off the discharge continuation switch SW2 to cause the target secondary current value I2*tgt* indicated by the target secondary current command signal IGA. The sub-primary coil control circuit 41 drives on and off the energization enabling switch SW4 based on the energy input signal IGW.

This allows feedback control to be performed based on the target secondary current value I2*tgt* while the energy input operation is being performed.

Ninth Embodiment

Figure 15:
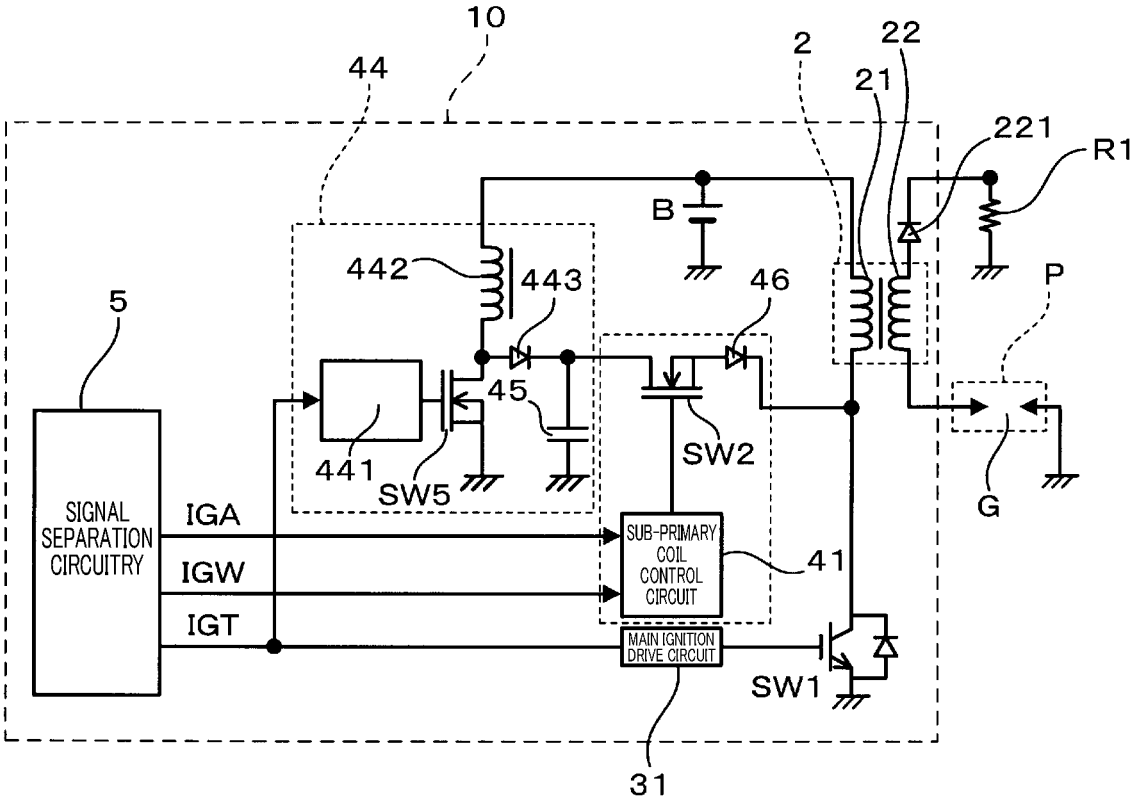
FIG. 15 is a schematic circuit diagram of an ignition control device for an internal-combustion engine according to a ninth embodiment.

The ignition control device for the internal-combustion engine according to a ninth embodiment will now be described with reference to FIG. 15.

In the embodiments set forth above, the primary coil 21 of the ignition coil 2 is formed of the main primary coil 21*a* and the sub-primary coil 21*b*, where the main primary coil 21*a* and the sub-primary coil 21*b* are connected in parallel with the DC power source B. The ignition control device DC is not limited to this configuration, but may be configured such that, as illustrated in FIG. 15, the ignition coil 2 is formed of the primary coil 21 and the secondary coil 22. In addition, a boost circuit 44 and a capacitor 45 are provided in the energy input circuitry 4 such that energy stored in the capacitor 45 is to be input to a ground side of the primary coil 21 in a superposed manner.

In the present embodiment, the boost circuit 44 includes a switching element for boosting (referred to as a boost switch) SW5, a boost drive circuit 441 for driving the boost switch SW5, a choke coil 442, and a fifth diode 443. The boost drive circuit 441 drives on and off the boost switch SW5 to store in the capacitor 45 energy generated in the choke coil 442. The discharge continuation switch SW2 is connected between the primary coil 21 and the main ignition switch SW1 via a sixth diode 46, and is driven by the energy-input drive circuit 43. A direction from the fifth diode 443 toward the capacitor 45 is a forward direction. A direction from the sixth diode 46 toward the primary coil 21 is a forward direction.

The boost drive circuit 441 is driven based on the main ignition signal IGT and charges the capacitor 45 during the main ignition operation. The energy-input drive circuit 41 drives, based on the target secondary current command signal IGA and the energy input signal IGW, the discharge continuation switch SW2 during an energy input period after the main ignition operation, thereby inputting the energy stored in the capacitor 45 into the ground side of the primary coil 21 in a superposed manner. Also with such a configuration, the energy input operation is performed by increasing the secondary current I2 and the same polarity current, which enables continuation of the spark discharge.

In this way, the ignition coil 2 and the energy input circuitry 4 may be arbitrarily modified. For example, in addition to the configuration of the first embodiment, the boost circuit 44 of the ninth embodiment may be provided to supply power from the boost circuit 44 to the sub-primary coil 21*b*, thereby performing the energy input operation. Two ignition coils 2 each formed of the primary coil 21 and the secondary coil 22 may be provided, where the main ignition operation is performed using one of the ignition coils 2 and the energy input operation is performed using the other of the ignition coils 2.

Although the disclosure has been described in terms of particular embodiments, additional embodiments and modifications can be generated without departing from the spirit or exceeding the scope of the disclosure.

In the embodiments set forth above, various signals have been described as positive logic signals, where, for example, the ignition control signal IG is a logic '1' when the signal voltage of the ignition control signal IG is at a HIGH level. In an alternative embodiment, the various signals may be negative logic signals where signal voltage levels are inverted. In the embodiments set forth above, the target secondary current command signal IGA is set to a zero voltage to prohibit the energy input operation. In an alternative embodiment, the target secondary current command signal IGA may be an arbitrary voltage value to set off switch control for the energy input operation. Further, the target secondary current command signal IGA may be switched in response to, for example, the power-supply voltage. Changes in voltage that DC power source can supply will cause changes in energy that can be superposed. Therefore, for example, switching the target secondary current command signal IGA to be generated in the signal separation circuitry 5, in response to the power-supply voltage, enables optimal control of the energy input operation.

The internal-combustion engine is not limited to a gasoline engine for a vehicle, but may be any spark ignition type internal-combustion engine. The configurations of the ignition coil 2 and the ignition device 10 may be changed, as needed to suit the internal-combustion engine.

What is claimed is:

1. An ignition control device for an internal-combustion engine, comprising:

an ignition coil formed of a primary coil and a secondary coil, for generating discharge energy in the secondary coil connected to a spark plug by increasing or decreasing a primary current flowing through the primary coil;

main ignition circuitry configured to control energization of the primary coil to perform a main ignition operation for generating a spark discharge in the spark plug;

energy input circuitry configured to perform an energy input operation for superposing, on a secondary current flowing through the secondary coil generated by the main ignition operation, a current of same polarity;

signal separation circuitry configured to receive an ignition control signal that is an integrated signal of a main ignition signal for controlling the main ignition operation, an energy input signal for controlling the energy input operation, and a target secondary current command signal, and separate the received ignition control signal into the main ignition signal, the energy input signal, and the target secondary current command signal that are included in the received ignition control signal, wherein the ignition control signal is formed of a first signal and a second signal that are pulsed signals, and the signal separation circuitry is configured to generate, from the ignition control signal, the main ignition signal based on rising edges of the first signal and the second signal as pulse-waveform information of the first signal and the second signal, generate the energy input signal based on a pulse width of the second signal as pulse-waveform information of the second signal, and generate the target secondary current command signal based on pulse-waveform information of the first signal.

2. The ignition control device according to claim 1, wherein the energy input signal indicates a time period during which the energy input operation is performed, and the target secondary current command signal indicates whether to perform the energy input operation and energy to be input.

3. The ignition control device according to claim 1, wherein the signal separation circuitry is configured to generate the target secondary current command signal based on a pulse width of the first signal.

4. The ignition control device according to claim 1, wherein the signal separation circuitry is configured to generate the target secondary current command signal based on a number of times the first signal is output within a predefined time period from a rising edge of the ignition control signal.

5. The ignition control device according to claim 1, wherein the signal separation circuitry is configured to generate the target secondary current command signal based on an output signal level of the first signal.

6. The ignition control device according to claim 1, wherein the signal separation circuitry is configured to generate the target secondary current command signal based on a duty cycle of the first signal.

7. The ignition control device according to claim 1, wherein the signal separation circuitry is configured to detect the first signal and the second signal based on an order in which the first signal and the second signal are input to the signal separation circuitry after beginning operation of the ignition control device or pulse-waveform information of the first signal and the second signal.

8. The ignition control device according to claim 7, wherein pulse waveforms of the first signal and the second signal are different in output signal level at least in the first instance of output, and the signal separation circuitry is configured to detect the first signal based on a predefined output signal level.

9. The ignition control device according to claim 7, wherein pulse waveforms of the first signal and the second signal are different in pulse width at least in the first instance of output, and the signal separation circuitry is configured to detect the first signal based on a predefined pulse width.

10. The ignition control device according to claim 1, wherein the primary coil includes a main primary coil and a sub-primary coil, and the energy input circuitry is configured to control the energy input operation by controlling energization of the sub-primary coil.

11. The ignition control device according to claim 1, wherein the signal separation circuitry is incorporated in an ignition device including the main ignition circuitry and the energy input circuitry.

12. The ignition control device according to claim 1, wherein the energy input circuitry comprises an energy input enabling period setter configured to set an enabling period in which the energy input operation is enabled and output an enabling signal for enabling the energy input operation.

13. The ignition control device according to claim 12, wherein the enabling signal is a pulse signal that is generated based on an output signal from the signal separation circuitry, and a pulse width of the enabling signal defines a maximum length of the enabling period.

14. The ignition control device according to claim 1, wherein the energy input circuitry is configured to terminate the energy input operation in response to the target secondary current command signal being at a zero level.

15. The ignition control device according to claim 1, further comprising an ignition control signal transmitter configured to generate and output the ignition control signal.

* * * * *